US011339982B2

(12) United States Patent
Niedermann

(10) Patent No.: US 11,339,982 B2
(45) Date of Patent: May 24, 2022

(54) RECONFIGURABLE PORTABLE HUMIDIFIER AND METHOD OF USING THE PORTABLE HUMIDIFIER

(71) Applicant: Dirk Niedermann, Naples, FL (US)

(72) Inventor: Dirk Niedermann, Naples, FL (US)

( * ) Notice: Subject to any disclaimer, the term of this patent is extended or adjusted under 35 U.S.C. 154(b) by 0 days.

(21) Appl. No.: 17/242,446

(22) Filed: Apr. 28, 2021

(65) Prior Publication Data

US 2021/0341158 A1 Nov. 4, 2021

Related U.S. Application Data

(63) Continuation-in-part of application No. 16/862,025, filed on Apr. 29, 2020.

(51) Int. Cl.

| | |
|---|---|
| ***F24F 6/12*** | (2006.01) |
| ***B01F 23/20*** | (2022.01) |
| ***B01F 23/213*** | (2022.01) |

(52) U.S. Cl.

CPC ..... *F24F 6/12* (2013.01); *B01F 23/213* (2022.01); *B01F 23/2133* (2022.01)

(58) Field of Classification Search

CPC ..... F24F 6/12; B01F 23/213; B01F 23/2133
See application file for complete search history.

(56) References Cited

U.S. PATENT DOCUMENTS 6,019,355 A * 2/2000 Birdsell ..... F24F 1/04 261/142

FOREIGN PATENT DOCUMENTS

| | | |
|---|---|---|
| CA | 1320432 A | 7/1993 |
| CN | 209744627 U | 12/2019 |
| JP | 07293950 H | 11/1995 |

OTHER PUBLICATIONS

Tikaton (Mumba) Travel Humidifier, thingsthatfold.com/humidifier, Mar. 10, 2020.
Search Report dated Oct. 26, 2021 in Appln. No. GB2106136.1.

* cited by examiner

*Primary Examiner* — Robert A Hopkins
(74) *Attorney, Agent, or Firm* — Wood, Phillips, Katz, Clark & Mortimer

(57) ABSTRACT

A portable humidifier and a method of using the same. The portable humidifier has a frame; a fluid droplet generator on the frame; and a fluid containment unit for a supply of fluid. The fluid droplet generator is operable to cause fluid droplets generated from fluid from the supply in the fluid containment unit to become entrained in environmental air in a space in which the portable humidifier is located. The fluid containment unit has a wall structure that is selectively reconfigurable to occupy different surrounding volumes.

30 Claims, 14 Drawing Sheets

RECONFIGURABLE PORTABLE HUMIDIFIER AND METHOD OF USING THE PORTABLE HUMIDIFIER

CROSS-REFERENCE TO RELATED APPLICATIONS

This application is a continuation-in-part of U.S. patent application Ser. No. 16/862,025 filed Apr. 29, 2020.

BACKGROUND OF THE INVENTION

Field of the Invention

This invention relates to portable space conditioners and, more particularly, to a portable humidifier that can be reconfigured to occupy different volumes. The invention is also directed to a method of using such a portable humidifier.

Background Art

Many different versions of portable space humidifiers currently exist, for personal use and for use in business environments. This category of humidifier has two principle components; a) a generator of fluid droplets that can be entrained in air in a space to be treated; and b) a containment unit for a supply of fluid, typically transportable with the droplet generator, commonly separable from the droplet generator, and configured to continuously deliver fluid to the droplet generator. The droplet generator may rely upon heat to vaporize a fluid or may cause droplets to be generated, as by using vibrated membranes of the type disclosed in U.S. Pat. Nos. 8,308,145 and 9,845,962, or by using other well-known structures and methods.

The desirability of functioning at all times in comfortably humidified environments has spawned the development of many different types of portable humidifiers that can now be transported readily, as in briefcases and luggage. Examples of these types of humidifiers are ones adaptable to cooperate with cap threads on a disposable plastic water bottle and ones that can be immersed in a conventional-type drinking glass.

While focus is on compact design to facilitate transportation of different humidifier structures, this end is commonly achieved at the expense of being able to provide a containment unit of substantial capacity to allow the humidifier to operate continuously for adequate time periods without requiring replenishment of the fluid supply. For example, a very small fluid containment unit may hold only enough fluid that the humidifier will operate for a handful of hours. Ideally, in a hotel room, a traveler would desire to continuously operate the humidifier through an entire sleep cycle. Unless the containment unit is periodically refilled, which is obviously inconvenient and impractical during sleeping hours, the desired humidity level in a space generally may not be maintainable. This problem is aggravated by the fact that it is difficult with most designs to ascertain the amount of fluid remaining in a containment unit without up close inspection of fluid level, which may be made difficult by aesthetic coloring of tank walls through which liquid levels must be observed.

Maximizing fluid containment capacity may also be a problem in units scaled up from the highly portable designs, discussed above. Some residential humidifier designs are commonly made with a containment unit having a one or two gallon capacity. While this larger capacity allows humidifiers to be operated for time periods long enough that refilling does not become onerous, such designs introduce other problems.

Large capacity humidifiers are commonly designed to strategically distribute a volume of fluid droplets into a space while having an aesthetically pleasing appearance. These objectives may result in a relatively high, and/or bulky, profile. While during operation, this may not be a particular problem, it creates inconvenience and adds expense associated with packaging, storing, displaying, and otherwise handling such humidifiers.

In the highly competitive portable humidifier market, display space in retail stores is at a premium and desirable locations within such stores are generally expensive. A relatively small number of units may take up a significant volume of display space in retail establishments which may significantly affect the bottom line profit on sales.

Further, large humidifier units require a complementary containment carton shape which, aside from its large size, may have to incorporate expensive and complicated cushioning to protect the humidifier parts being handled and shipped in such cartons.

From the standpoint of the consumer, a large volume portable humidifier, whether in a container or apart therefrom, may be inconvenient to handle and store. This is particularly a problem since room humidifiers are generally considered to be seasonal items usable primarily in periods when dry, heated air is present in an occupied space. Thus, many consumers will store portable humidifiers out of sight when they are not in use. A large humidifier represents an obvious inconvenience in this regard.

While the demand for portable humidifiers that allow individuals to increase humidity in spaces they occupy throughout their home, business, and recreational life, has increased, the industry has been challenged to balance the competing objectives of making humidifiers compact and allowing them to be operated continuously for adequate times that they do not need to be refilled, as in the middle of the night, or at inconvenient intervals. Heretofore, designers have generally focused their efforts on either compactness/portability or extended use capability without having the ability to reach an acceptable balance.

SUMMARY OF THE INVENTION

In one form, the invention is directed to a portable humidifier having: a frame; a fluid droplet generator on the frame; and a fluid containment unit for a supply of fluid. The fluid droplet generator is operable to cause fluid droplets to be generated from fluid from the supply in the fluid containment unit and to become entrained in environmental air in a space in which the portable humidifier is located. The fluid containment unit has a wall structure that is selectively reconfigurable to occupy different surrounding volumes.

In one form, the wall structure is reconfigurable back and forth in a predetermined manner between first and second shapes wherein the wall structure occupies different surrounding volumes.

In one form, the wall structure is configured to contain a supply of fluid independently of the frame.

In one form, the wall structure and frame are configured to cooperatively contain a supply of fluid.

In one form, the portable humidifier is changeable between: a) a first state wherein the frame and fluid containment unit are fully separated from each other; and b) a second state wherein the fluid containment unit is operatively joined to the frame, by relatively translating the fluid containment unit and frame without requiring manipulation of any separate fasteners.

In one form, the wall structure has first and second spaced wall portions. A peripheral wall portion extends between the first and second wall portions. The wall structure is selectively reconfigurable to allow the first and second wall portions to be moved towards and away from each other.

In one form, the wall structure has a peripheral wall portion that extends around an axis and bounds a part of a fluid containment volume. The peripheral wall portion is controllably collapsible in an axial direction to selectively increase and decrease the fluid containment volume. The peripheral wall portion has a stepped perimeter that allows at least a first part of the peripheral wall portion to be moved relative to a second part of the peripheral wall portion to thereby change a degree of axial overlap of the first and second parts of the peripheral wall portion and, as an incident thereof, the fluid containment volume.

In one form, the wall structure has a top wall portion connected to the peripheral wall portion. The top wall portion has an outlet through which fluid droplets generated by the fluid droplet generator discharge to a space in which the portable apparatus is located. The wall structure has a bottom wall portion connected to the peripheral wall portion. There are connectors on the frame and bottom wall portion that cooperate to releasably maintain a predetermined operatively joined relationship between the fluid containment unit and the frame.

In one form, the connectors on the frame and bottom wall portion have cooperating male and female parts that are movable into and out of a connected relationship by relative movement in an axial direction. The male and female parts have radially oppositely facing surfaces.

In one form, the fluid droplet generator is configured to generate fluid droplets by using at least one of: a) heat; b) water diffusion; c) ultrasonic energy; d) wicking; e) convection; and f) evaporation.

In one form, the portable humidifier is configured so that as an incident of fluid droplets being generated and discharged from the portable humidifier, negative pressure is generated within an internal volume bounded at least in part by the wall structure that causes the wall structure to reconfigure to occupy different surrounding volumes. The wall structure is reconfigured from a first shape into a second shape. The wall structure occupies a smaller surrounding volume in the second shape than in the first shape.

In one form, the portable humidifier is configured so that a part of the wall structure collapses in a predetermined manner in changing from the first shape into the second state.

In one form, there is one discrete surface on the first wall portion facing in one direction and a second discrete surface on the second wall portion that faces oppositely to the one direction. The one and second discrete surfaces are each engageable by fingers on a user's separate hands to allow an opposite force to be applied thereto to urge the first and second wall portions away from each other.

In one form, the first wall is a top wall and the second wall is a bottom wall. The top wall has at least one opening through which fluid can be directed to replenish the supply of fluid in the fluid containment unit.

In one form, the first wall portion is a top wall and the second wall portion is a bottom wall. The top wall portion has an opening therethrough in communication with a fluid containment volume bounded at least in part by a peripheral wall portion on the wall structure. The portable humidifier further has an access member movable between an open position and a blocking position. The access member in the blocking position at least partially blocks the opening in the top wall portion. The top wall further has a fluid droplet discharge outlet for fluid droplets generated by the fluid droplet generator. The top wall opening is spaced from the fluid droplet discharge outlet.

In one form, with the access member in the blocking position, the access member is situated to funnel fluid directed thereagainst into the top wall opening.

In one form, the portable humidifier has a fluid discharge for fluid droplets generated by the fluid droplet generator and another opening that vents a fluid containment volume bounded at least in part by a peripheral wall portion on the wall structure to control negative pressure generation in the fluid containment volume as the portable humidifier is operated.

In one form, the portable humidifier further includes a control assembly for selectively blocking the another opening. The control assembly is configured to block the another opening, as an incident of which negative pressure to a predetermined level can be generated in the fluid containment volume. The portable humidifier is configured so that upon the predetermined level of negative pressure being realized, the surrounding volume of the wall structure is caused to change.

In one form, the invention is directed to a method of conditioning air within a space. The method includes the steps of: a) obtaining a portable humidifier having: a frame; a fluid droplet generator on the frame and having "on" and "off" states; and a fluid containment unit for a supply of fluid, the fluid containment unit reconfigurable between at least first and second shapes and occupying a smaller surrounding volume with the fluid containment unit in the first state than in the second state; b) changing the fluid containment unit from the first shape into the second shape to thereby increase a size of a fluid containment volume defined by the fluid containment unit; c) placing fluid in the fluid containment volume within the fluid containment unit; d) with the fluid droplet generator in the "on" state and the fluid containment unit having the second shape, causing the fluid droplet generator to produce droplets of the fluid in the fluid storage volume and causing the fluid droplets to be discharged into the space; e) changing the fluid droplet generator from the "on" state into the "off" state and f) after performing steps d) and e), changing the fluid containment unit from the second shape back into the first shape.

In one form, the fluid containment unit has a wall structure that bounds the fluid containment volume. Step f) involves collapsing the wall structure in a predetermined manner.

In one form, the method further includes the step of separating the fluid containment unit from the frame.

In one form, the fluid containment unit has a vertical axis. The step of collapsing the wall structure involves collapsing the wall structure to reduce an axial extent of the wall structure.

In one form, the fluid containment unit has a vertical axis. The method further includes the step of separating the fluid containment unit from the frame by translating the fluid containment unit axially relative to the frame.

In one form, the step of obtaining the portable humidifier involves obtaining the portable humidifier in a container in which the fluid containment unit has the first shape.

In one form, the step of obtaining the portable humidifier involves obtaining the portable humidifier in a container in which the fluid containment unit has the first shape and the fluid containment unit is operatively connected to the frame.

In one form, the method further includes the steps of obtaining a cover that is separate from the portable humidifier and connecting the cover to the portable humidifier with the wall structure collapsed.

In one form, the step of connecting the cover involves press fitting the cover to the fluid containment unit.

In one form, the method further includes the step of changing the fluid containment unit from the second shape as an incident of performing step d).

In one form, the method further includes the step of changing the fluid containment unit from the second shape into the first shape as an incident of performing step d).

In one form, the fluid containment unit has an oval shape as viewed along the vertical axis.

DETAILED DESCRIPTION OF THE PREFERRED EMBODIMENT

Figure 1:
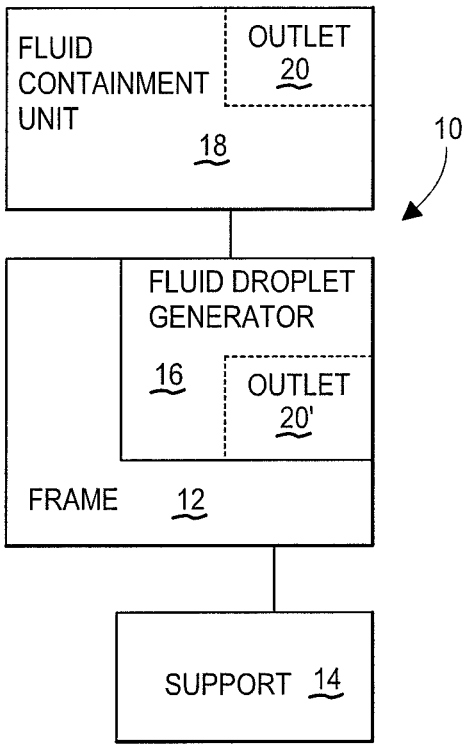
FIG. 1 is a schematic representation of a reconfigurable portable humidifier, according to the present invention.

The invention herein is directed to a portable humidifier of the type shown generically at 10 in FIG. 1. The humidifier is "portable" in the sense that it is designed to be conveniently lifted and moved by an individual from one location to the next to allow humidification of environmental air at different locations and to allow convenient movement to and from a storage location.

Typically, portable humidifiers are made for placement on floors or articles of furniture within rooms. As depicted, the humidifier 10 has a frame 12 which can be placed upon a support 14 at a desired location. A fluid droplet generator 16 on the frame 12 is operable to cause fluid droplets to be generated from fluid from a supply thereof in a fluid containment unit 18, whereupon the fluid droplets become entrained in environmental air in the space in which the portable humidifier 10 is located.

The generic showing of the fluid droplet generator 16 is intended to encompass all known and devised methods and apparatus for generating fluid droplets, among which are those using: a) heat; b) water diffusion; c) ultrasonic energy; d) wicking; e) convection; and f) evaporation to generate the fluid droplets that are commonly characterized as being in at least the cool mist and heated vapor/mist categories.

Typically, the fluid will be water by itself or water with one or more additives that may assist water droplet formation, provide a scent, etc. Fluids other than water might be utilized.

The apparatus 10 may be constructed so that the fluid droplets generated disperse in the space randomly or may be controllably discharged through one or both of outlets 20, 20', associated directly with the fluid containment unit 18 and fluid droplet generator 16, respectively.

The precise structure of the fluid droplet generator 16 is not critical to the present invention, and thus there is no need to describe the structure and operation thereof in any detail herein. An exemplary fluid droplet generator relying upon ultrasonic energy is disclosed in each of U.S. Pat. Nos. 8,308,145 and 9,845,962, respectively entitled "Apparatus for Delivering Humidified Air To A Surrounding Space" and "Portable Air Treatment System", the disclosures of which are incorporated herein by reference. This is but an exemplary form that should not be viewed as limiting.

Figure 2:
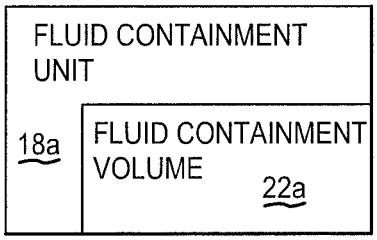
FIGS. 2 and 3 are schematic representations showing alternative constructions for a fluid containment unit on the portable humidifier in FIG. 1.

A supply of fluid is maintained in a fluid containment volume 22*a* shown to be defined entirely by the fluid containment unit 18*a* in FIG. 2.

Figure 3:
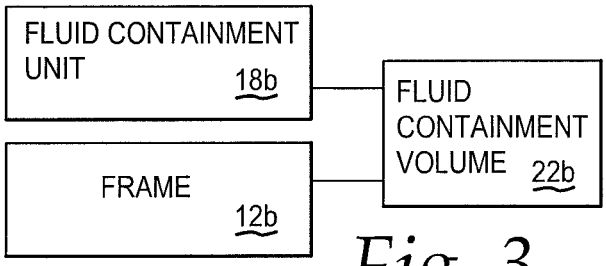

In an alternative form, as shown in FIG. 3, the fluid containment volume 22*b* is defined cooperatively by the fluid containment unit 18*b* and one or more receptacles on the frame 12*b*.

Figure 4:
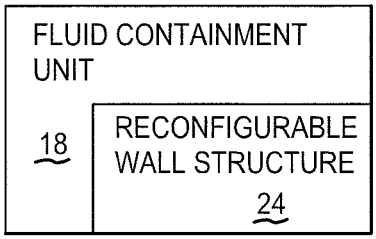
FIG. 4 is a schematic representation of the fluid containment unit, as shown in FIGS. 1-3, and showing additional detail thereof.

Regardless of whether the fluid containment volume is defined independently by the fluid containment unit or cooperatively by the fluid containment unit and frame as depicted in FIG. 4, the fluid containment unit 18 has an associated wall structure 24 that bounds at least part of the fluid containment volume. The wall structure 24 is selectively reconfigurable so that it, and the entire fluid containment unit 18, occupy different surrounding volumes. As used herein, "surrounding volume" refers to a space within a three-dimensional boundary circumscribing the perimeter of the wall structure 24. When configured to different shapes, the wall structure 24 has different surrounding volumes.

The schematic depiction of the reconfigurable wall structure 24 in FIG. 4 is intended to encompass virtually an unlimited number of different structures that allow change in shape and surrounding volume. The reconfigurable wall structure 24 may consist of a flexible type membrane that can be randomly reshaped, as by being enlarged upon the introduction of a fluid supply therewithin. Alternatively, a mechanical type structure is incorporated to allow a controlled repositioning/folding of parts of the reconfigurable wall structure 24. As just an example, hinges might be utilized to guide pivoting between parts, accordion-type folds might be incorporated, live hinge structures may be incorporated, etc.

While not a requirement, in a preferred form, as hereinbelow described, the reconfigurable wall structure 24 is such that it can be controllably and consistently changed back and forth between predictable different shapes that account for different surrounding volumes and fluid containment volumes.

The generic showing in FIGS. 1-4 is intended to encompass the specific forms hereinbelow described as well as virtually an unlimited number of different forms of components and their interaction that would be readily devised by one skilled in the art with the teachings herein in hand. The exemplary form of the invention herein is not intended to be limiting in nature.

Referring now to FIGS. 5-11, one preferred exemplary form of the portable humidifier 10 is shown to be made up of the aforementioned frame 12 and fluid containment unit 18.

Figure 5:
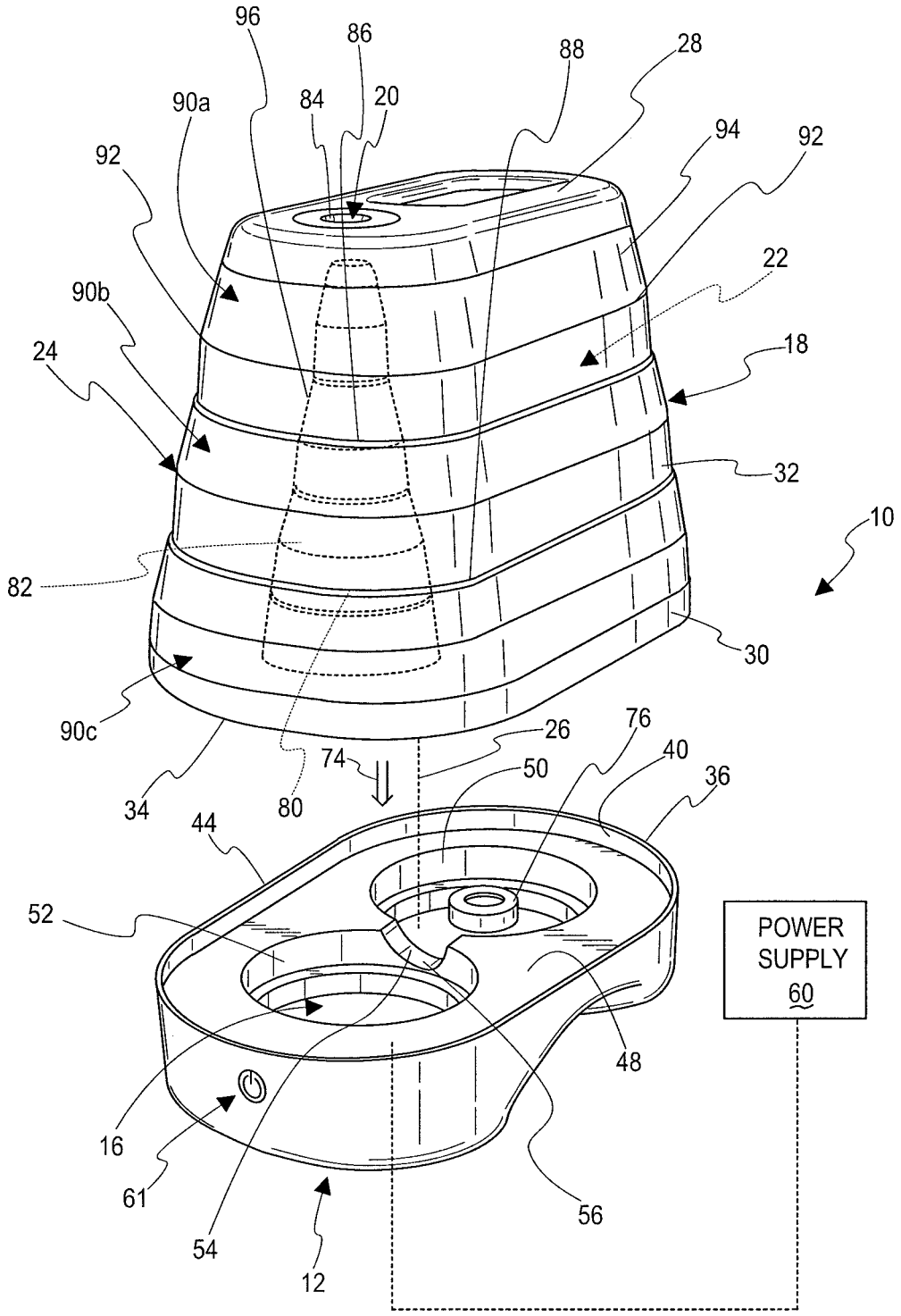
FIG. 5 is an exploded perspective view of one exemplary form of portable humidifier, as shown schematically in FIGS. 1-4 and with the fluid containment unit in an expanded state.
Figure 7:
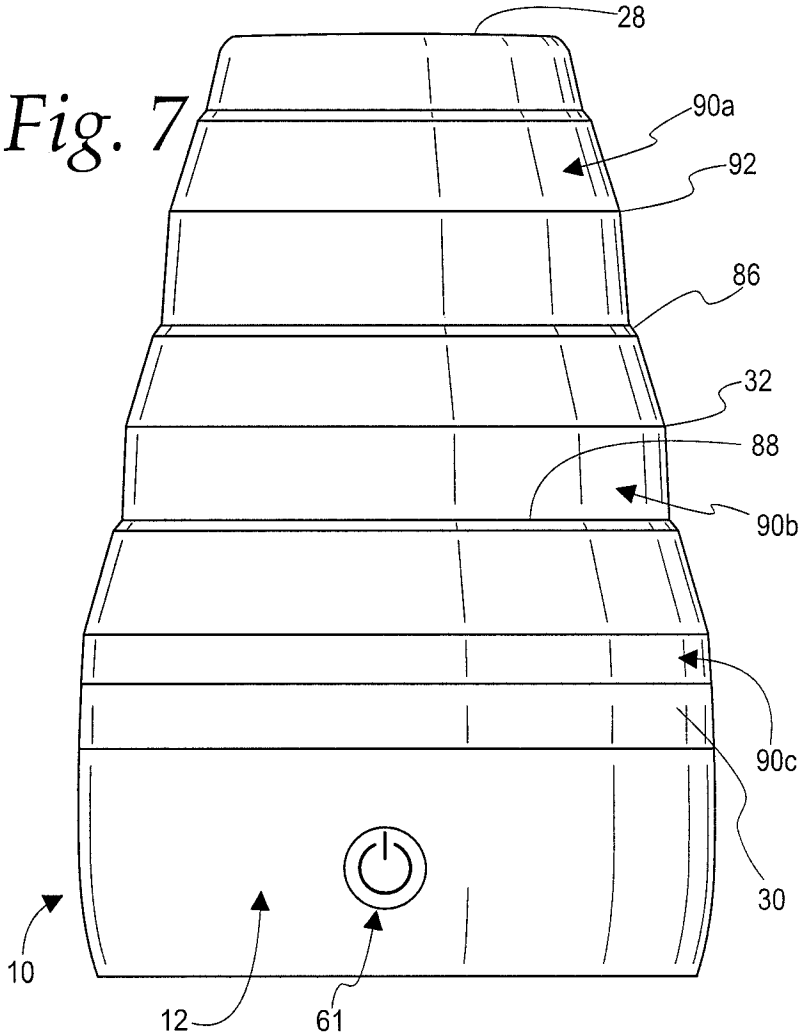
FIG. 7 is an enlarged, front elevation of the portable humidifier in the FIG. 6 state.
Figure 6:
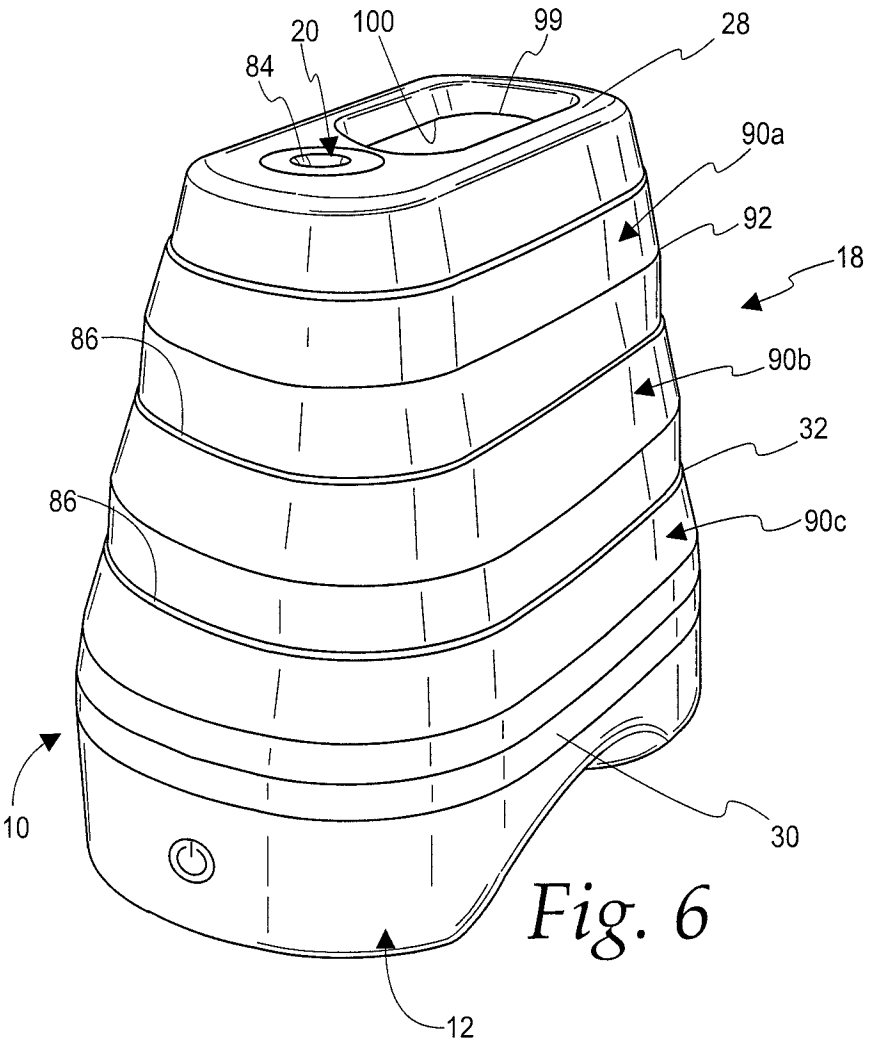
FIG. 6 is a view as in FIG. 5 with the fluid containment unit operatively joined to the frame.
Figure 8:
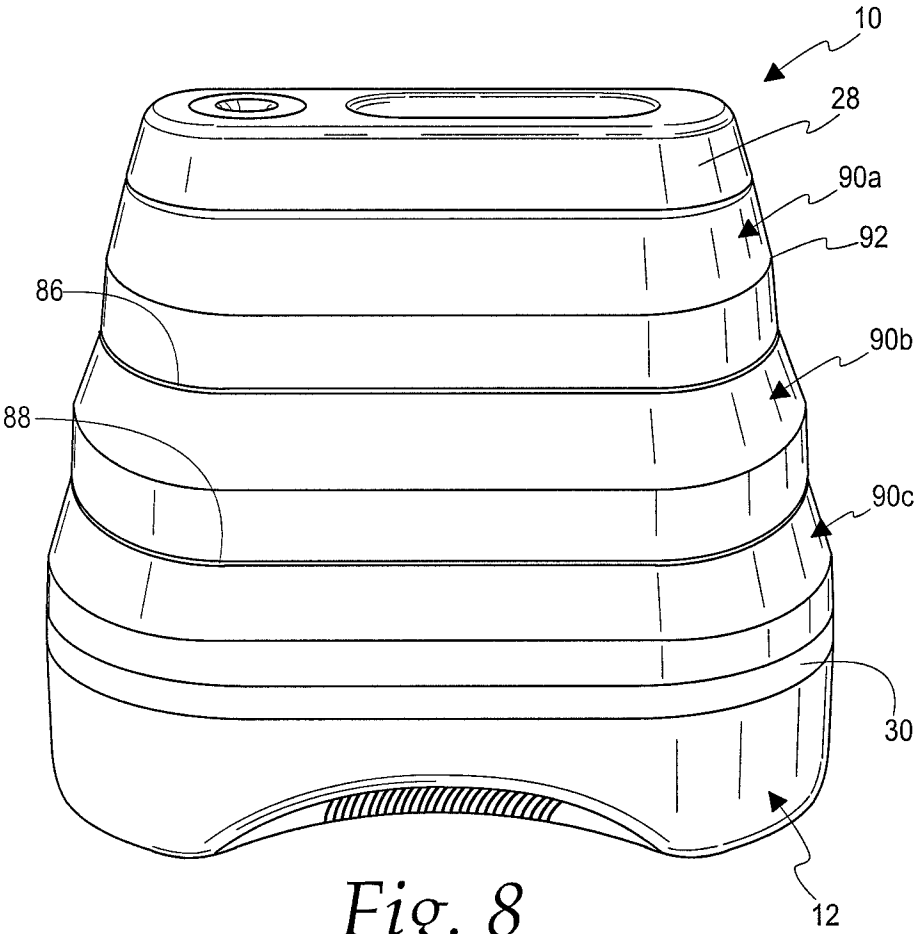
FIG. 8 is a side elevation view of the portable humidifier in the state in FIGS. 6 and 7.

The portable humidifier 10 is changeable between: a) a first state, as shown in FIG. 5, wherein the fluid containment unit 18 and frame 12 are fully separated from each other; and b) a second state, as shown in FIGS. 6-8, wherein the fluid containment unit 18 is operatively joined to the frame 12. The portable humidifier 10 can be changed between its first and second states by translating the frame 12 and fluid containment unit 18 towards and away from each other along a vertical axis 26 that is common for each of the frame 12 and fluid containment unit 18. As depicted, the change between the first and second states can be made without requiring tools or manipulation of any separate fasteners, as further described hereinbelow.

The wall structure 24 on the fluid containment unit 18 consists of a first, top wall portion 28 and a second, bottom wall portion 30, spaced axially from each other with the fluid containment unit 18 having the shape shown in FIGS. 5-8, 10, and 11. A peripheral wall portion 32 extends between the top and bottom wall portions 28, 30. The peripheral wall portion 32 extends around the axis 26 and bounds, in conjunction with the top and bottom wall portions 28, 30, the fluid containment volume 22.

There are connectors on the frame 12 and bottom wall portion 30 that cooperate to releasably maintain a predetermined operatively joined relationship between the fluid containment unit 18 and frame 12, as shown in FIGS. 6-9. The connectors consist of cooperating male and female configurations on the bottom wall portion 30 and frame 12, with a number of interacting configurations that support the operatively positioned fluid containment unit 18 consistently on the frame 12 as it is lowered axially into place thereon.

More specifically, the connector on the bottom wall portion 30 consists of a depending rim 34 extending fully around the axis 26 and nesting within the connector on the frame 12 defined by an upwardly projecting rim 36. In this embodiment, the rim 34 defines part of the "male" connector and resides within the rim 36. A radially outwardly facing surface 38 on the rim 34 confronts a radially inwardly facing surface 40 on the rim 36. The surfaces 38, 40 are substantially matching, with a slight difference in radial dimension to allow the fluid containment unit 18 to be guided, without significant interference, into its operative position supported by the frame 12.

Downward movement of the fluid containment unit 18 relative to the frame 12 is arrested by a downwardly facing surface 42 extending around the rim 34 and abutting to a top edge 44 of the rim 36.

Additional stability is afforded by providing a flat, downwardly facing surface 46 on the bottom wall portion 30 that abuts to, or is in close confronting relationship with, an upwardly facing surface 48 on the frame 12.

While the confronting surfaces 38, 40 extend fully around the axis 26, this is not a requirement. Further, the "male" and "female" connectors may be placed on either of the frame 12 and fluid containment unit 18.

As depicted, the shapes of the top wall portion 28, bottom wall portion 30, peripheral wall portion 32, and frame 12, as viewed along the axis 26, have the same oval shape, which is dictated primarily by aesthetics. The oval shape of the frame 12 is, however, convenient by reason of generally conforming to two cup-shaped receptacles 50, 52, spaced from each other along the major axis of the oval and in communication with each other through a cutout 54 in an upper region of a wall 56 between the receptacles 50, 52.

The receptacle 50 receives fluid stored within the volume 22 and continuously feeds the fluid through gravitational force from the receptacle 50 through the cutout 54 and into the receptacle 52. At the base of the receptacle 52, the fluid droplet generator 16 is located. As noted above, it is not necessary to understand the details of operation thereof, with it sufficing to say that water droplets are generated and caused to rise from the receptacle 52 for transmission through the fluid containment unit 18 to an outlet 20. The fluid droplet generator 16 is powered by an appropriate supply 60, which may be a household current, batteries, etc. An on/off switch 61 is provided on the frame 12.

The fluid is introduced to the containment volume 22 by way of a fill opening 62 through the bottom wall portion 30. The wall bounding the fill opening 62 is threaded to cooperate with threads on a cap 64 with a contoured peripheral surface 66 that conveniently allows fingers grasping the cap 64 to nest, thereby facilitating turning thereof.

The cap 64 has a check valve 68 which is normally biased to a sealed state. By pressing on the check valve 68 axially upwardly, as indicated by the arrow 70 in FIG. 10, fluid in the volume 22 can discharge from the volume 22 through the cap 64.

The bottom wall portion 30 has an associated graspable handle 72 that has a bowed shape spanning the rim 34 parallel to the minor axis of the oval shape of the bottom wall portion 30. By grasping the handle 72, the fluid containment unit 18 can be comfortably held in the inverted orientation of FIG. 10, whereupon fluid can be introduced into the containment volume 22 through the fill opening 62 with the cap 64 loosened and separated from the bottom wall portion 30.

Figure 9:
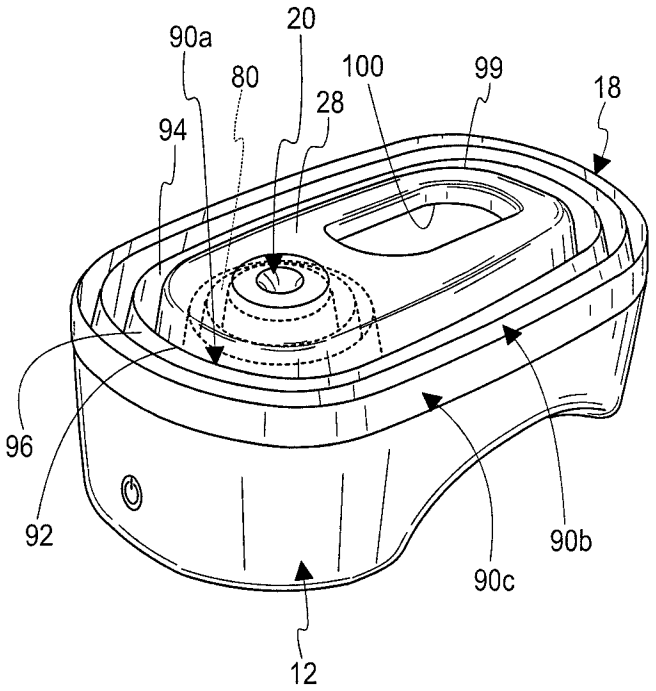
FIG. 9 is a view as in FIG. 6 wherein the fluid containment unit is in a collapsed state.
Figure 10:
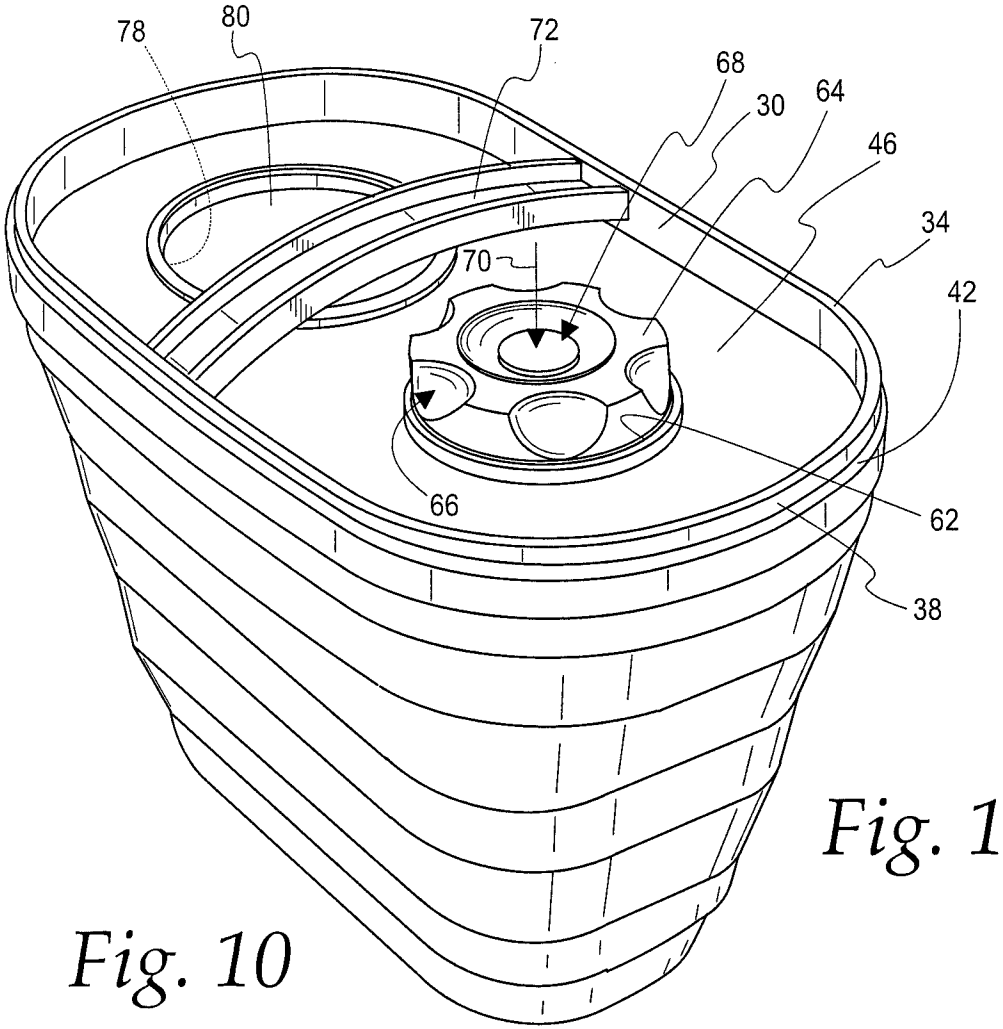
FIG. 10 is an enlarged, bottom perspective view of the fluid containment unit in FIGS. 5-9 in the expanded state.

With the fluid container unit 18 filled with a supply of fluid, it can be inverted from the FIG. 10 orientation, aligned with the frame 12 as in FIG. 5, and directed downwardly in the direction of the arrow 74, as shown in FIG. 5, until operatively joined with the frame, as seen in FIGS. 6-9. As the bottom wall portion 30 moves into the frame receptacle defined by the bottom wall portion surfaces 36, 40, the cap 64 is advanced into the receptacle 50, whereupon an upwardly projecting plunger 76 in the receptacle 50 acts against the check valve 68 and opens the same, at least once the fluid containment unit 18 is fully operatively positioned.

The bottom wall portion 30 has a separate opening 78 therethrough with a shape that overlies and registers with the complementarily-shaped receptacle 52 on the frame 12. A collapsible guide column 80 is fit sealingly within the opening 78 and extends fully from the bottom wall portion 30 to the top wall portion 28 and defines an internal passageway 82 that communicates between the opening 78 and the outlet 20 formed at the top wall portion 28.

As depicted, the guide column 80 has a truncated conical shape that converges upwardly towards the outlet 20. Generated fluid droplets from the frame 12 funnel upwardly through the passage 82 to be expelled at the outlet 20 upstream at which there is a surrounding guide surface 84 that causes a controlled dispersion of the droplets from the outlet 20 into the space in which the humidifier 10 resides.

Figure 11:
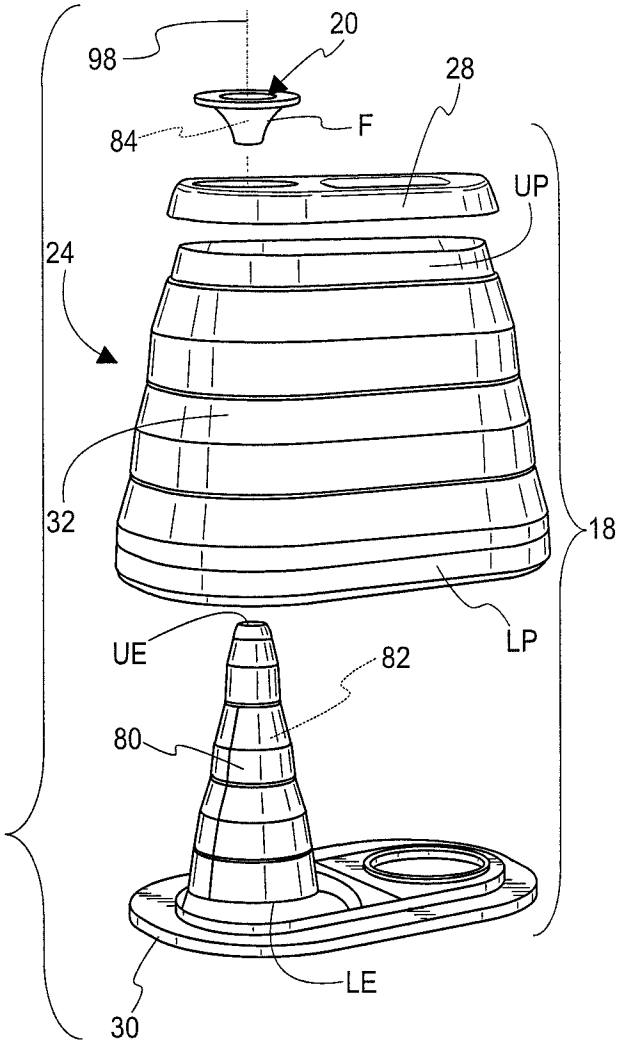
FIG. 11 is an exploded perspective view of the fluid containment unit as depicted in FIGS. 5-10.

In this embodiment, the peripheral wall structure 32 and guide column 80 are reconfigurable by being axially collapsible from the shapes/states in FIGS. 5 and 11 to the states shown in FIG. 9 to allow the top and bottom wall portions 28, 30 to be moved towards each other into the relationship shown in FIG. 9.

In this embodiment, the peripheral wall portion 32 is made from a flexible material, such as silicone, which is readily reconfigurable. The peripheral wall portion is formed with a stepped perimeter, in this case with first and second steps 86, 88, which produce a progressively enlarging oval shape between three different oval ring parts 90*a*, 90*b*, 90*c*. The ring parts 90*a*, 90*b*, 90*c* are substantially the same, with the exemplary ring part 90*a* having a mid-height bulge at 92 which defines a live hinge location. By pressing down upon the top wall portion 28, the ring region 94 above the bulge 92 folds inside of the ring portion 96 on the ring part 90*a* below the bulge 92. This folding pattern can be seen in FIG. 9 for the ring part 90*a*.

The downward pressure on the top wall portion 28 causes serial folding of the ring parts 90*b*, 90*c*, in the same manner as for the ring part 90*a*, until the compact collapsed configuration for the fluid containment unit 18 of FIG. 9 is realized. With this arrangement, the top wall portion 28 is allowed to collapse into axial overlapping relationship with the folded ring parts 90 to produce a relatively low vertical profile.

The guide column 80 can be made with a similar folding/collapsible configuration or any other type of arrangement, such as accordion folds, or the like, that allow it to compress axially to generally match the collapsed axial dimension of the peripheral wall portion 32 and top wall portion. A thin flexible membrane material, without any self-maintained volume or shape, and connected between the wall portions 28, 30, would function as well.

As seen most clearly in FIG. 11, in one exemplary form, the peripheral wall portion 32 is joined to upper and lower parts UP, LP, respectively, each made as from polypropylene, by overmolding liquid silicone rubber to define a subassembly that is joined to the top and bottom wall portions 28, 30. The upper part UP may be considered to be part of either the top wall portion 28 or the peripheral wall portion 32. Likewise, the lower part LP may be considered to be part of either the bottom wall portion 30 or the peripheral wall portion 32. For purposes of simplicity, the upper and lower parts UP, LP will be treated herein as part of the peripheral wall portion 32.

The upper part UP nests within and is fixed to the top wall portion 28 with the lower part LP fixed to the bottom wall portion 30 to form the fluid containment unit 18.

While not so limited in construction, the depicted collapsible guide column 80 is formed with a stepped diameter from overmolded liquid silicone rubber. The upper end UE and lower end LE of the guide column 80 are respectively joined to a funnel piece F at the top wall portion 28 and the bottom wall portion 30.

The funnel piece F defines the outlet 20 and has the aforementioned surface 84 that diverges upwardly and guides discharging humidified air upwardly and radially outwardly fully around an axis 98 of the funnel piece F at the outlet 20. This outlet shape generally is usable for generated "warm mist" and "cool mist" and is preferred in designs that generate water droplets through heating.

The top wall portion 28 has an opening 99 that produces a graspable handle/rim 100 around the periphery thereof. By grasping the handle 100, the top wall portion 28 can be conveniently drawn axially upwardly, causing the ring parts 90*a*, 90*b*, 90*c* to follow in sequence until the expanded configuration for the fluid containment unit 18 at FIG. 5 is realized.

With the construction shown, the wall structure 24 has two distinct and consistently selectable shapes in FIGS. 6 and 9, with the latter accounting for a substantially reduced surrounding volume than the former. As a transition is occurring between the FIGS. 6 and 9 shapes, the fluid containment volume progressively changes. It is possible to partially collapse the peripheral wall portion 32 and operate the portable humidifier 10 with the wall structure 24 having an intermediate, consistently settable shape. With this particular design, the degree of axial overlap of the ring parts 90 determines the size of the flow containment volume.

With this design, the peripheral wall portion 32 is changeable back and forth consistently between predetermined shapes dictated by the strategic formation of the ring parts 90, which control folding of the ring parts 90 and collapsing of the peripheral wall portion 32.

Figure 13:
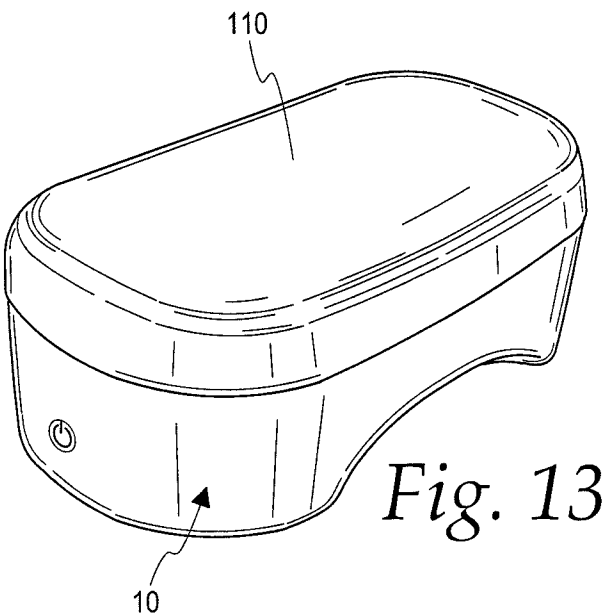
FIG. 13 is a view as in FIG. 12 with the cover connected to the collapsed fluid containment unit.
Figure 12:
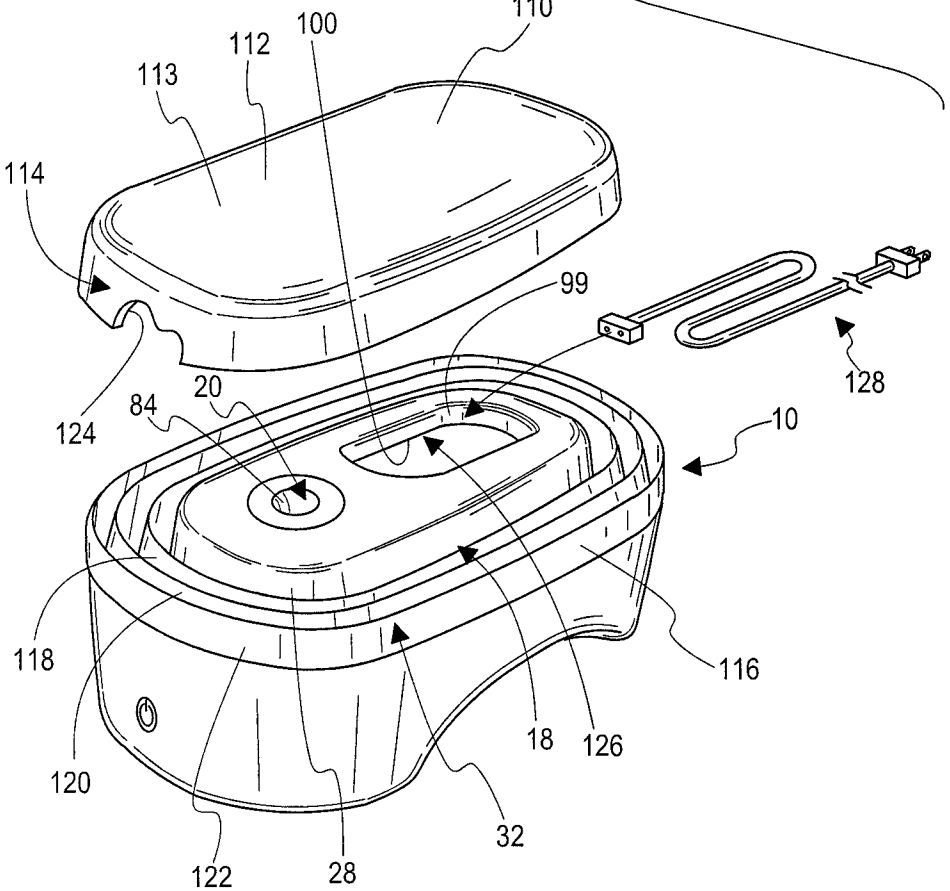
FIG. 12 is a view as in FIG. 9 with a cover for the collapsed fluid containment unit spaced thereabove and aligned to be connected thereto.

As shown in FIGS. 12 and 13, an optional cover 110 may be provided that may be press fit to the portable humidifier 10 with the fluid containment unit 18 collapsed. The cover 110 has a wall 112 with a substantially cup shape with a flat wall portion 113 having a depending peripheral rim 114 that closely embraces the peripheral surface 116 on the outermost of three nesting ring shapes 118, 120, 122 that result from the collapsing of the peripheral wall portion 32. An inside surface 124 on the peripheral rim 114 closely embraces the surface 116 about its full peripheral extent to releasably frictionally maintain the cover 110 connected to the collapsed fluid containment unit 18, as shown in FIG. 13.

With the fluid containment unit 18 on the portable humidifier 10 collapsed, a cavity 126 is formed in communication with the opening 98. With the portable humidifier 10 powered as by 120 volt service, a separable power cord 128 can be folded and directed through the opening 98 to be stored in the cavity 126. The power cord 128 is blocked in the stored position by the connected cover 110.

Apart from providing a dust cover and confining the stored power cord 128, the cover 110 conveniently affords a sliding surface as can be used to guide the combined portable humidifier 10 and cover 110 in the FIG. 13 state into and out of a container, as used for shipping, or a compartment at a storage location. The covered portable humidifier 10 thus potentially has a fully surrounding hard shell that protects particularly, but not only, the collapsed fluid containment unit 18.

While a multitude of different modifications from the basic construction described above are contemplated, within the generic showings herein, a number of such variations will be briefly described below.

Figure 15:
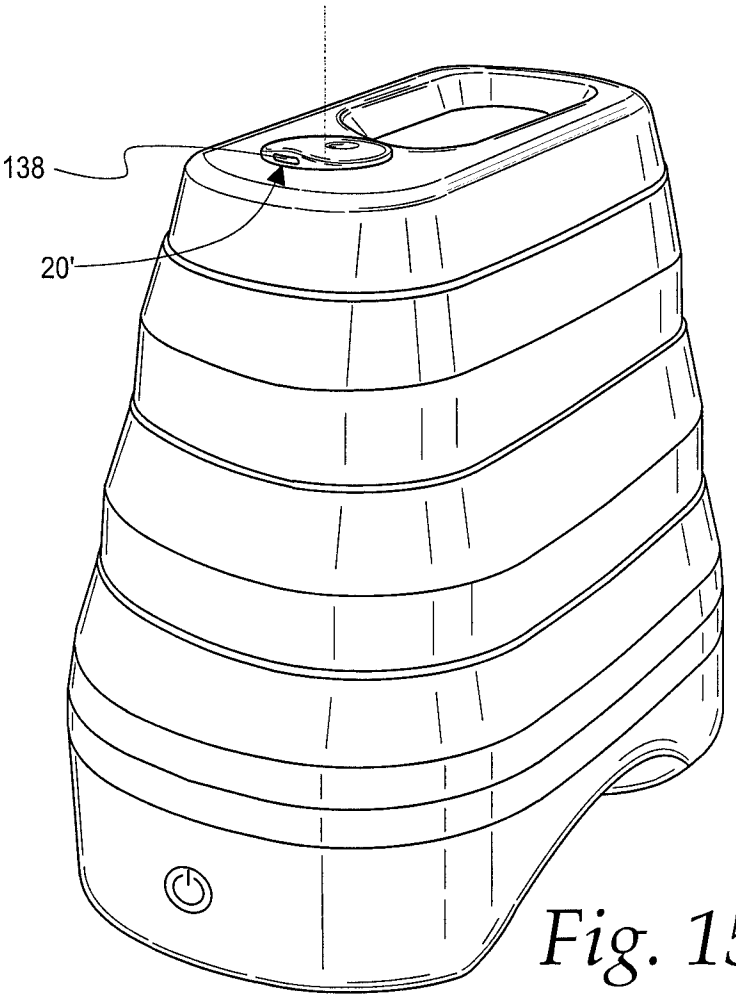
FIG. 15 is a view as in FIG. 6 with the assembled fluid containment unit in FIG. 14.
Figure 14:
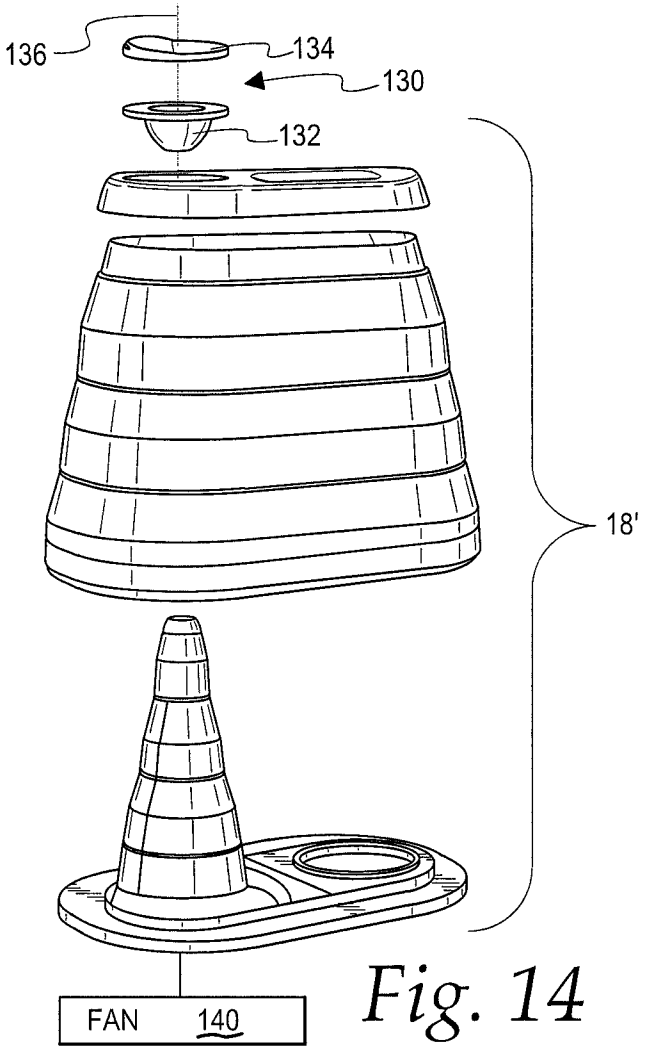
FIG. 14 is a view as in FIG. 11 with a different form of structure for distributing humidified air into a space occupied by the reconfigurable portable humidifier.

In FIGS. 14 and 15, the fluid containment unit 18' is shown substantially as in FIG. 11 with the exception that the funnel piece F is substituted for by a nozzle assembly at 130, consisting of a cup-shaped expansion guide component 132, at the top of which a disc-shaped nozzle 134 is attached. The nozzle 134 is configured to cooperate with the component 132 to redirect upwardly traveling humidified air substantially radially relative to the axis 136 of the component 132. In this embodiment, the nozzle 134 has an elongate opening 138 defining the outlet 20'. By turning the nozzle 134 guidingly relative to the component 132 around the axis 136, the radial direction of discharge of humidified air can be selected within a 360° range.

The construction of the fluid containment unit 18', in FIGS. 14 and 15 with the nozzle assembly 130, is preferred for portable humidifiers that generate water droplets without requiring heat and that typically use the assistance of a fan 140 to cause discharge and dispersion of water droplets into a space.

The construction of the fluid containment unit 18' is otherwise substantially the same as the fluid containment unit 18 as shown in FIG. 11.

Figure 16:
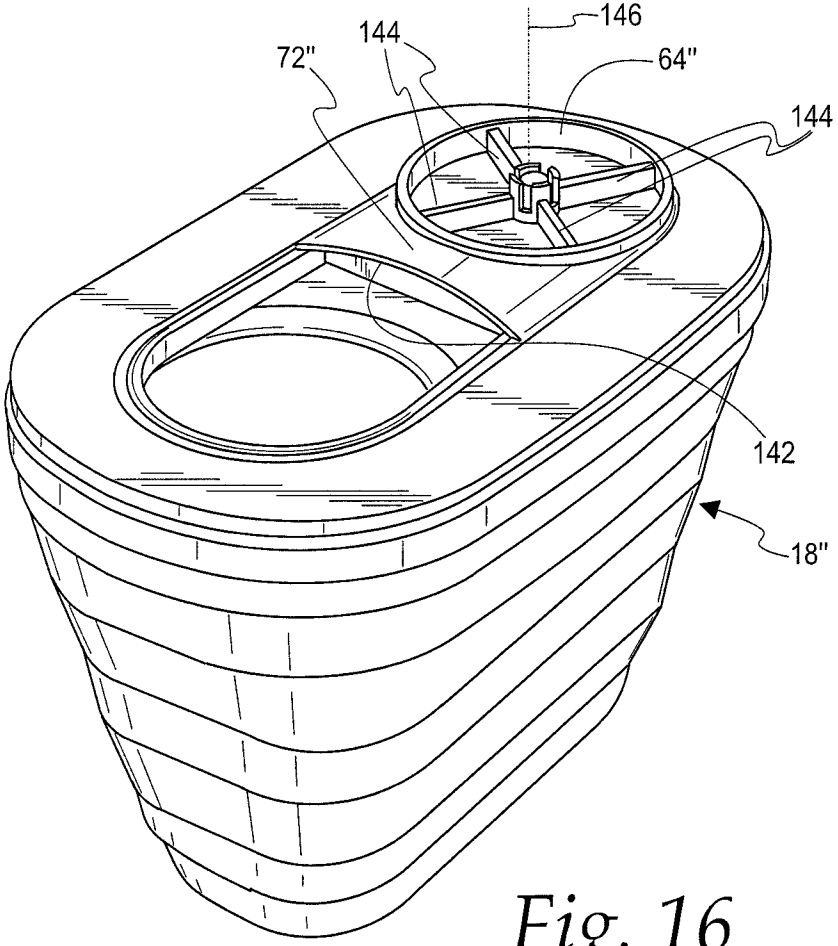
FIG. 16 is a view similar to that in FIG. 10 and showing a modified form of fluid containment unit, according to the invention.

In FIG. 16, a further modified form of fluid containment unit is shown at 18". The fluid containment unit 18" differs from the fluid containment unit 18 primarily by reason of integrally forming a handle 72" by molding the bottom wall with an integral bowed region that creates a concave surface 142 that can be comfortably engaged by a user's hand to allow exertion of an upward force on the fluid containment unit 18" in the FIG. 16 orientation with a supply of fluid therein.

A further modification in FIG. 16 is to a cap 64" that has radially projecting walls 144 that produce a "T" shape as viewed along a turning axis 146 for the cap 64". The "T" shape is conveniently graspable to allow hand turning thereof.

Figure 17:
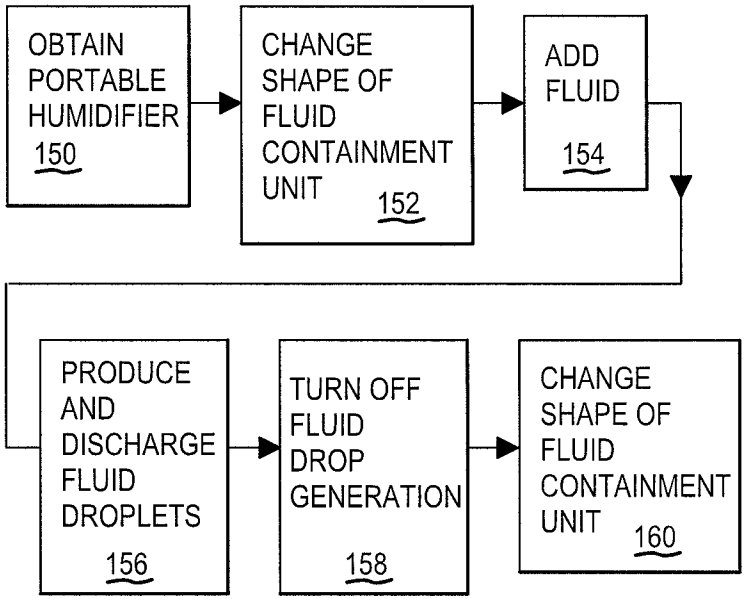
FIG. 17 is a flow diagram representation of a method of conditioning air within a space, according to the invention.

With the above structure, a method of conditioning air within a space can be performed, as shown in flow diagram form in FIG. 17.

As shown at block 150, a portable humidifier, as described above, is obtained.

As shown at block 152, the shape of the fluid containment unit is changed as a result of changing the shape of the peripheral wall portion from a collapsed shape into a more expanded shape.

As shown at block 154, fluid is added to the fluid containment volume within the fluid containment unit.

As shown at block 156, the fluid droplet generator is changed from an "off" state into an "on" state, thereby causing fluid droplets to be produced and discharged into the space.

As shown at block 158, the fluid droplet generator is then changed from the "on" state into the "off" state.

As shown at block 160, after performing the above steps at blocks 150-158, the shape of the fluid containment unit is changed by changing the shape of the peripheral wall portion into a more compact axial configuration wherein the fluid containment unit itself, and the operatively joined fluid containment unit and frame, have a reduced surrounding volume.

With this construction, handling of the portable humidifier between manufacturer and user can be carried out as follows. The manufacturer can package the portable humidifier with the peripheral wall portion on the associated fluid containment unit in its collapsed shape preferably with the separate cover in FIGS. 12 and 13 connected. A packaging container can be made with a size adapted to this smaller surrounding volume. A container may be provided for the frame and collapsed fluid containment unit together as in FIG. 9 with or without the cover in FIGS. 12 and 13. Alternatively, the fluid containment unit and frame may be placed in separate containers. The latter allows the flexibility to offer interchangeable fluid containment units with different capacity. This different capacity may be accounted for by providing additional ring parts or making the ring parts with different axial dimensions. Collapsibility of the peripheral wall portions can take place in the same manner, regardless of the desired vertical dimension of the fluid containment unit.

In one variation of the inventive portable humidifier, as shown at 210 in FIGS. 18-26, a frame 212 has an associated fluid droplet generator 216 that is operable to cause fluid droplets to be generated from fluid from a supply thereof at least partially in a releasably joinable fluid containment unit 218.

The portable humidifier 210 is configured to generate fluid droplets by virtually an unlimited number of different means, as described with respect to the portable humidifier 210.

The primary differences between the portable humidifiers 10, 210 relate to the construction of the fluid containment unit 218.

The fluid containment unit 218 has an opening/outlet 220 through which fluid droplets generated disperse in a space in which the portable humidifier 210 is located.

The fluid containment unit 218 has an associated wall structure 224 that bounds at least part of a fluid containment volume. The wall structure 224 is reconfigurable in substantially the same manner as the wall structure 24, described above, to thereby produce different "surrounding volumes".

The wall structure 224 has a first, top wall/top wall portion 228 and a second, bottom wall/bottom wall portion 230 spaced axially from each other with the wall structure 224 in the expanded shape depicted in FIGS. 18-20 and 22. The shape is changeable the same as is the shape of the wall structure 24, as described above, principally by causing axial collapsing and expanding of a peripheral wall structure 232 between the top and bottom wall portions 228, 230, respectively.

With the fluid containment unit 218 and frame 212 in a first state, the same as that for the corresponding components on the portable humidifier 10, and the fluid droplet generator 216 operated, the generated fluid droplets are delivered through a guide column 233 to and through the opening/outlet 220 in the top wall 228. The guide column 233 resides between the top wall 228 and bottom wall 230 and communicates through the bottom wall 230 through an opening 234 to accept the generated fluid droplets.

The wall structure 224 is changeable between at least first and second shapes, corresponding to those same shapes for the wall structure 24, as described above. Potentially other intermediate shapes are achievable.

The top wall 228 has at least one elongate opening 236 through which fluid can be directed to replenish the supply thereof in the fluid containment unit 218.

The top wall 228 has a further opening 238 therethrough in communication with the fluid containment volume bounded at least in part by the peripheral wall structure 232. The opening 238 is preferably sufficiently large to accept a hand of a user to allow cleaning of the surfaces within and bounding the fluid containment volume.

The top wall 228 has an upwardly extending, U-shaped wall 240 extending partially around the opening 238. The wall 240 is wedge-shaped with the largest vertical dimension at the base 242 of the "U".

An insert at 244 has a body 246 that nests into the "U" shape and snap connects thereto. The insert defines the elongate opening 236.

Figure 18:
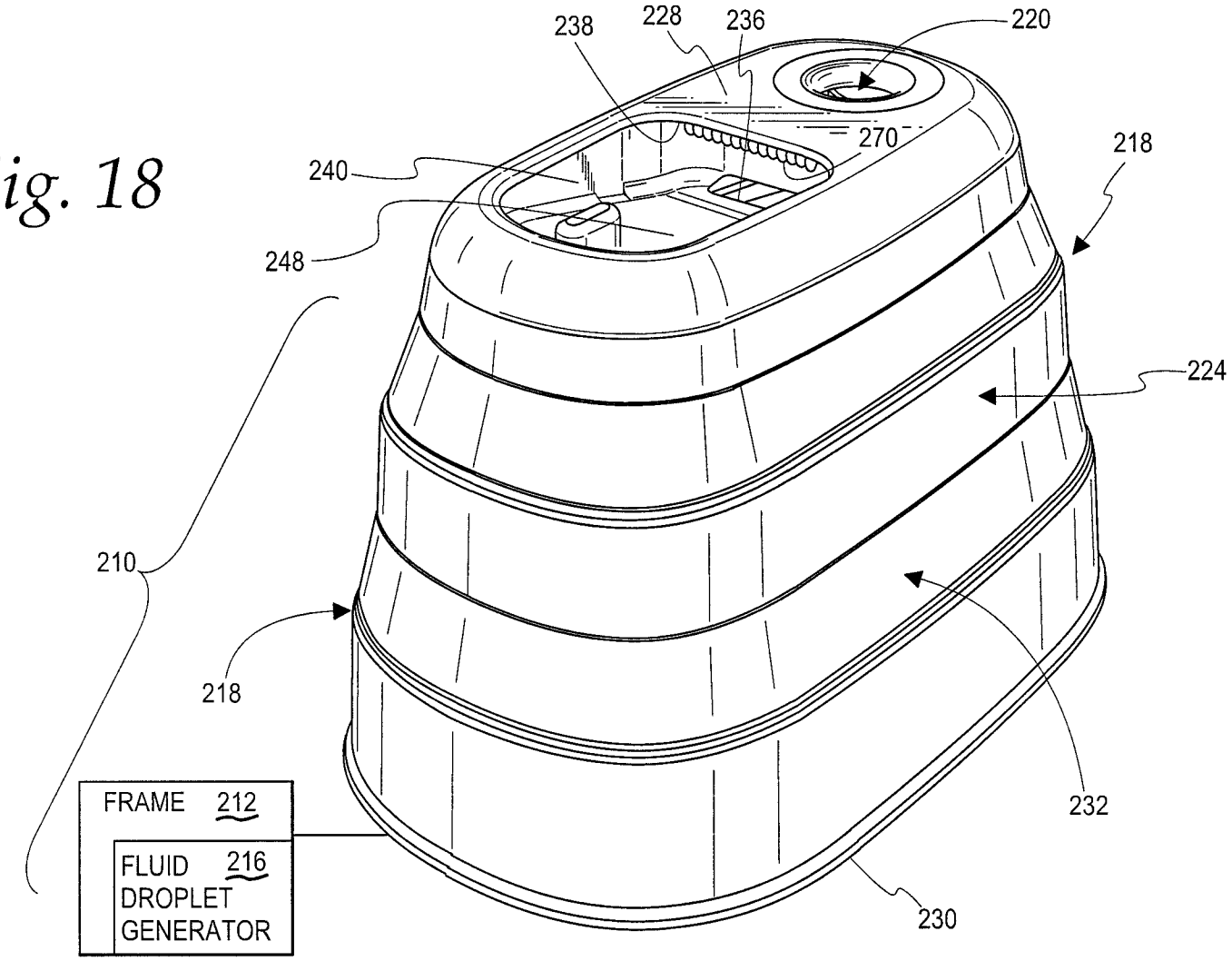
FIG. 18 is a partially schematic representation of another form of reconfigurable portable humidifier, according to the present invention, and including a separable fluid containment unit.
Figure 19:
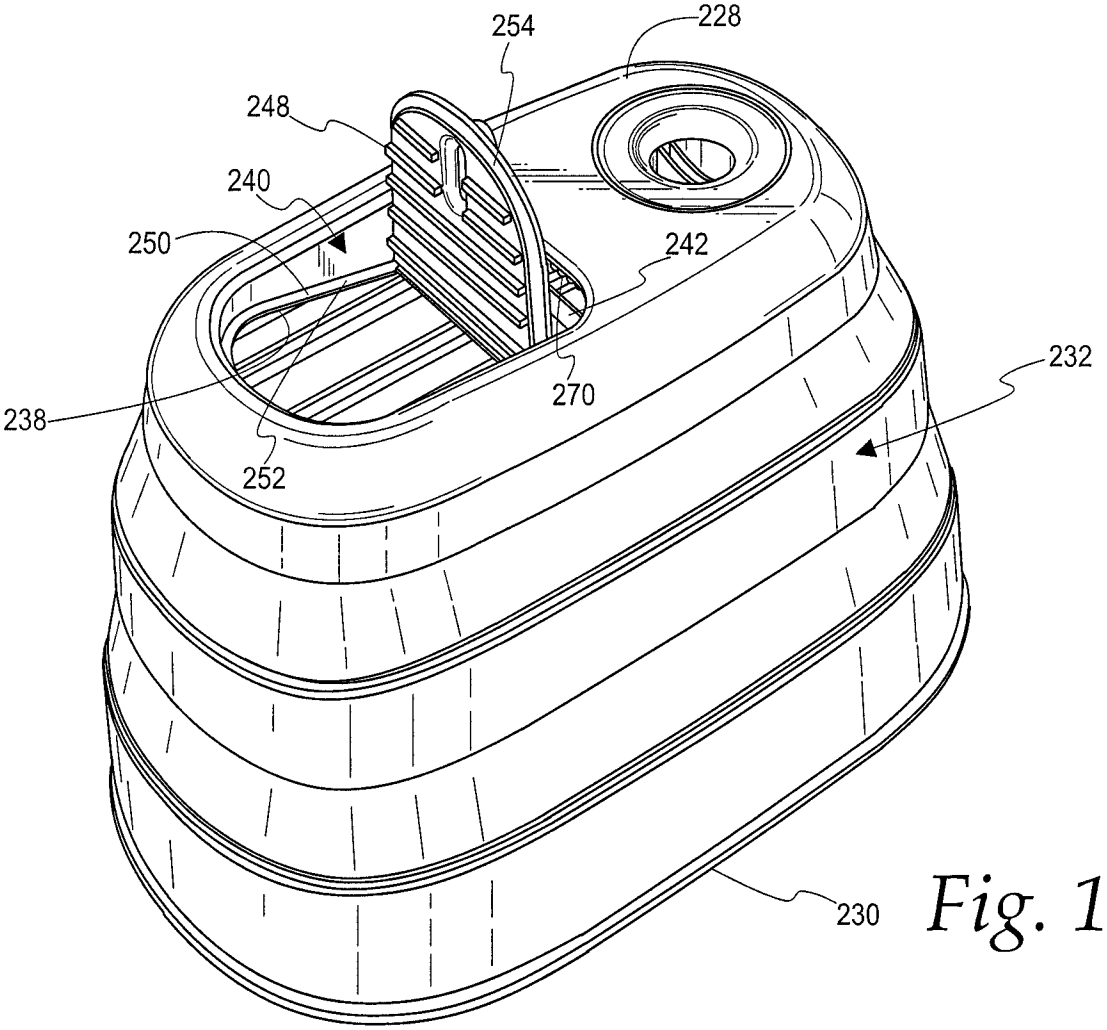
FIG. 19 is a perspective view of the fluid containment unit in FIG. 18 and showing an access member changed from a blocking position, as in FIG. 18, to an open position.
Figure 20:
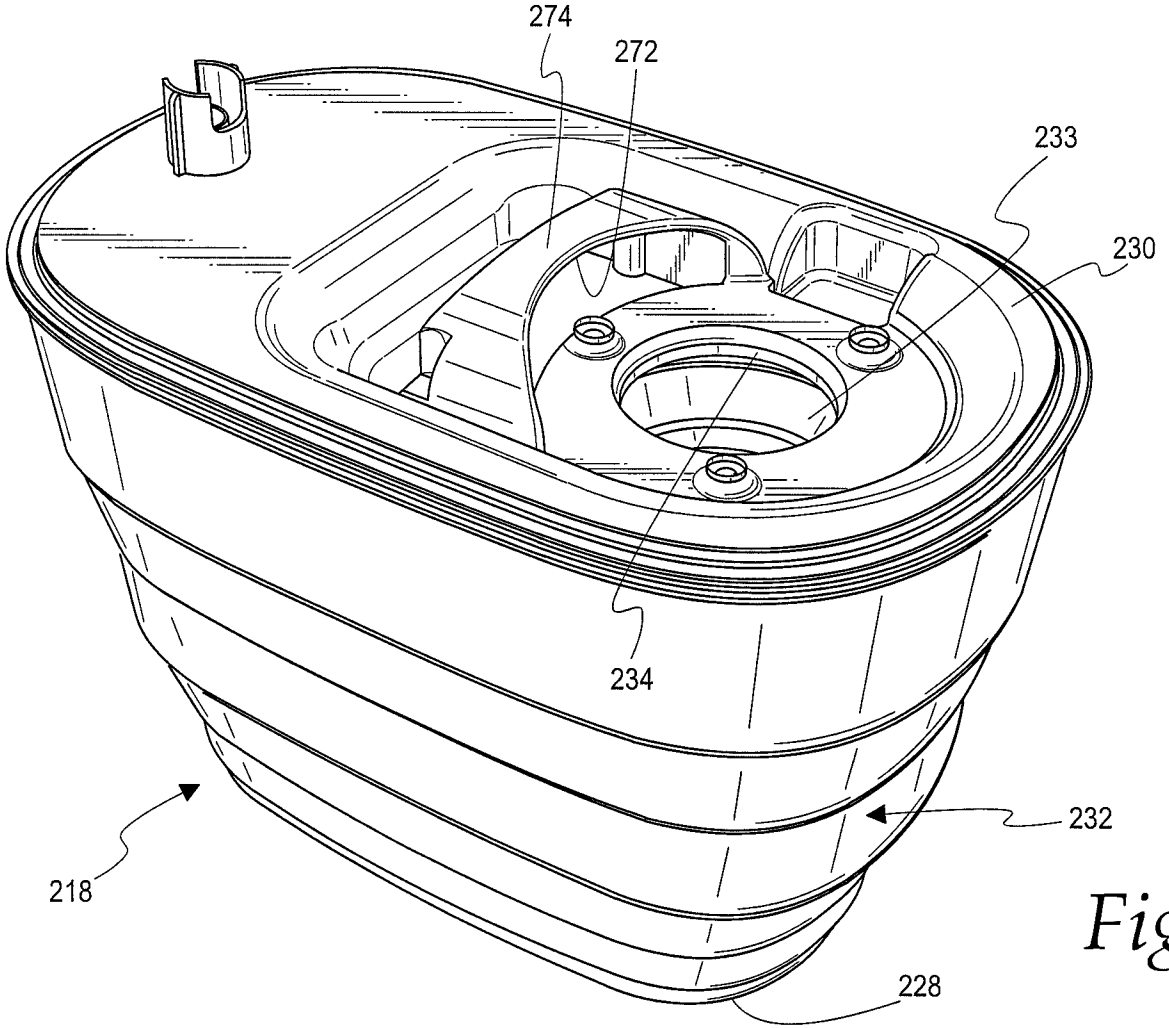
FIG. 20 is a bottom perspective view of the fluid containment unit in FIGS. 18 and 19.
Figure 21:
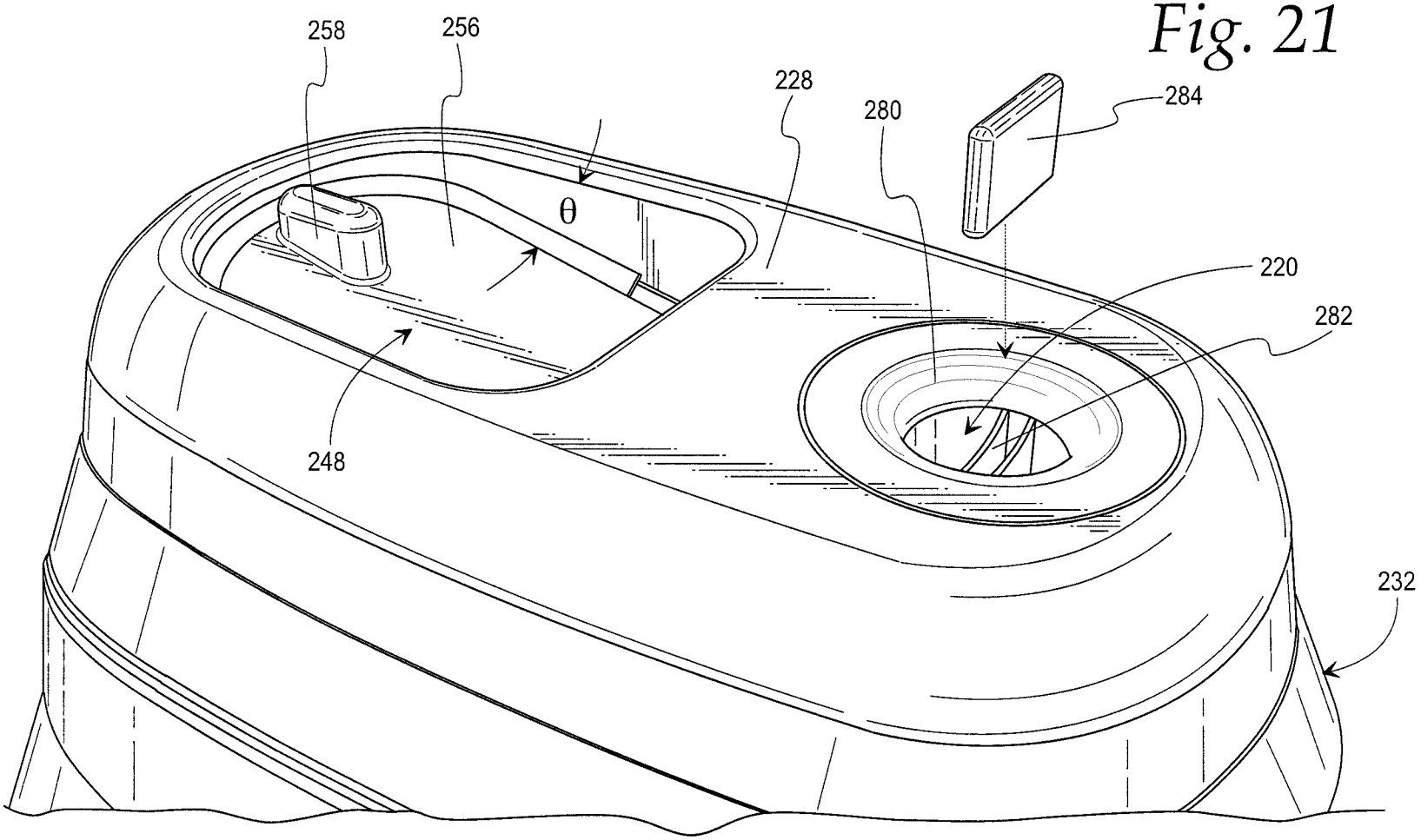
FIG. 21 is a fragmentary view of the fluid containment unit as in FIG. 18 and with a scent component being directed into a receptacle.
Figure 22:
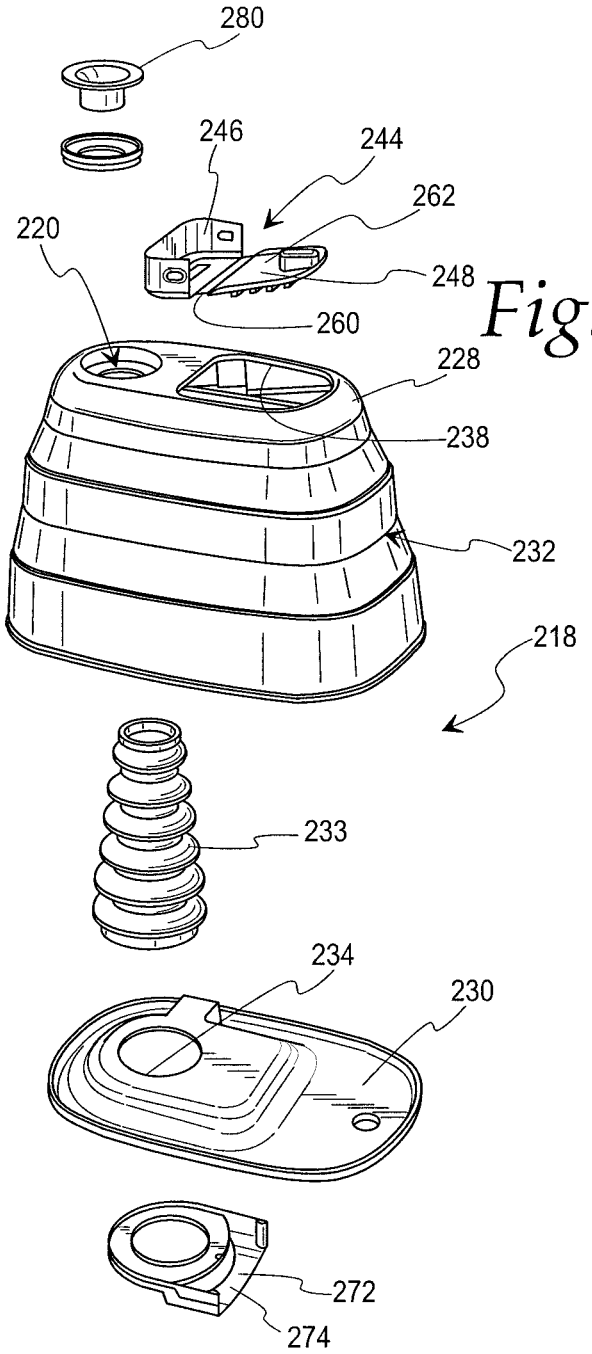
FIG. 22 is an exploded, perspective view of the fluid containment unit in FIGS. 18-21.

An access member 248 on the body 246 is movable between an open position, as shown in FIG. 19, and a blocking position, as shown in FIGS. 18 and 21. In the blocking position, the access member 248 at least partially blocks the opening 238. As depicted, the opening 238 is substantially fully blocked by the access member 248.

Further, as depicted, a rim 250 with an upwardly facing surface 252 extends around the opening 238 and seats a complementary edge 254 on the perimeter of the access member 248 to effect substantial, or full, blocking of the opening 238, as viewed from above.

With the access member 248 in the blocking position of FIGS. 18 and 21, a surface 256 thereon is inclined at an angle θ to horizontal whereby the fluid directed downwardly against the surface 256 is funneled by the surface 256 and wall 240 into the elongate opening 236.

Both openings 236, 238 are spaced in the same general direction away from the opening/outlet 220.

The access member 248 has an enlarged boss 258 thereon which can be grasped by a user to facilitate pivoting of the access member 248 between its blocking and open positions. In the embodiment depicted, a live hinge 260 connects the blocking part 262 of the access member 248 to the remainder of the body 246. Any type of hinge structure or other mechanical connection could be utilized to allow the desired range of movement for the access member between open and blocking positions therefor.

Aside from facilitating cleaning of the fluid containment volume, the described configuration permits top filling of the fluid containment volume, whereas the aforementioned construction discloses, without limitation, a bottom filling configuration.

Aside from facilitating filling, the opening 236 provides venting to avoid generation of a significant negative pressure within the fluid containment volume as the fluid droplets generated are continuously discharged.

Another optional aspect of the portable humidifier 210 is that it can be constructed to have an automatically collapsing peripheral wall structure 232 in the event an adequate negative pressure is allowed to be generated within the fluid containment volume bounded by the wall structure 224. To accomplish this, the wall structure 224 is constructed so that in an empty state it will maintain its collapsed or fully extended shapes.

Figure 24:
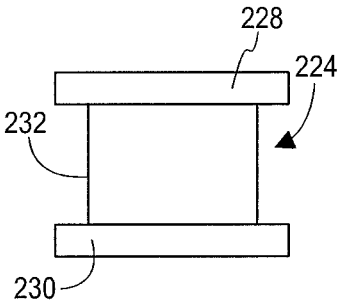
FIG. 24 is a schematic representation of the wall structure on the fluid containment unit in FIGS. 18-23 with a full supply of fluid and/or with the droplet generator not being operated.
Figure 25:
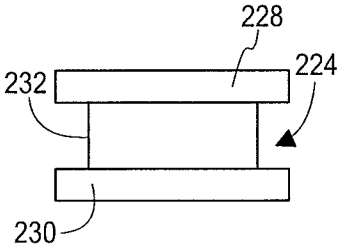
FIG. 25 is a view as in FIG. 24 wherein the control assembly of FIG. 23 is incorporated and a predetermined level of negative pressure has been generated within the fluid containment volume to allow a partial collapse of the peripheral wall structure.
Figure 26:
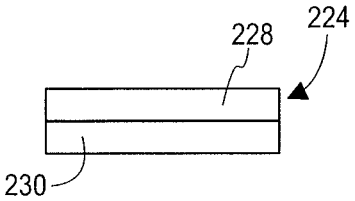
FIG. 26 is a view as in FIGS. 24 and 25 wherein the fluid containment volume is empty and the wall structure has been fully collapsed, as due to a negative pressure within the fluid containment volume.
Figure 23:
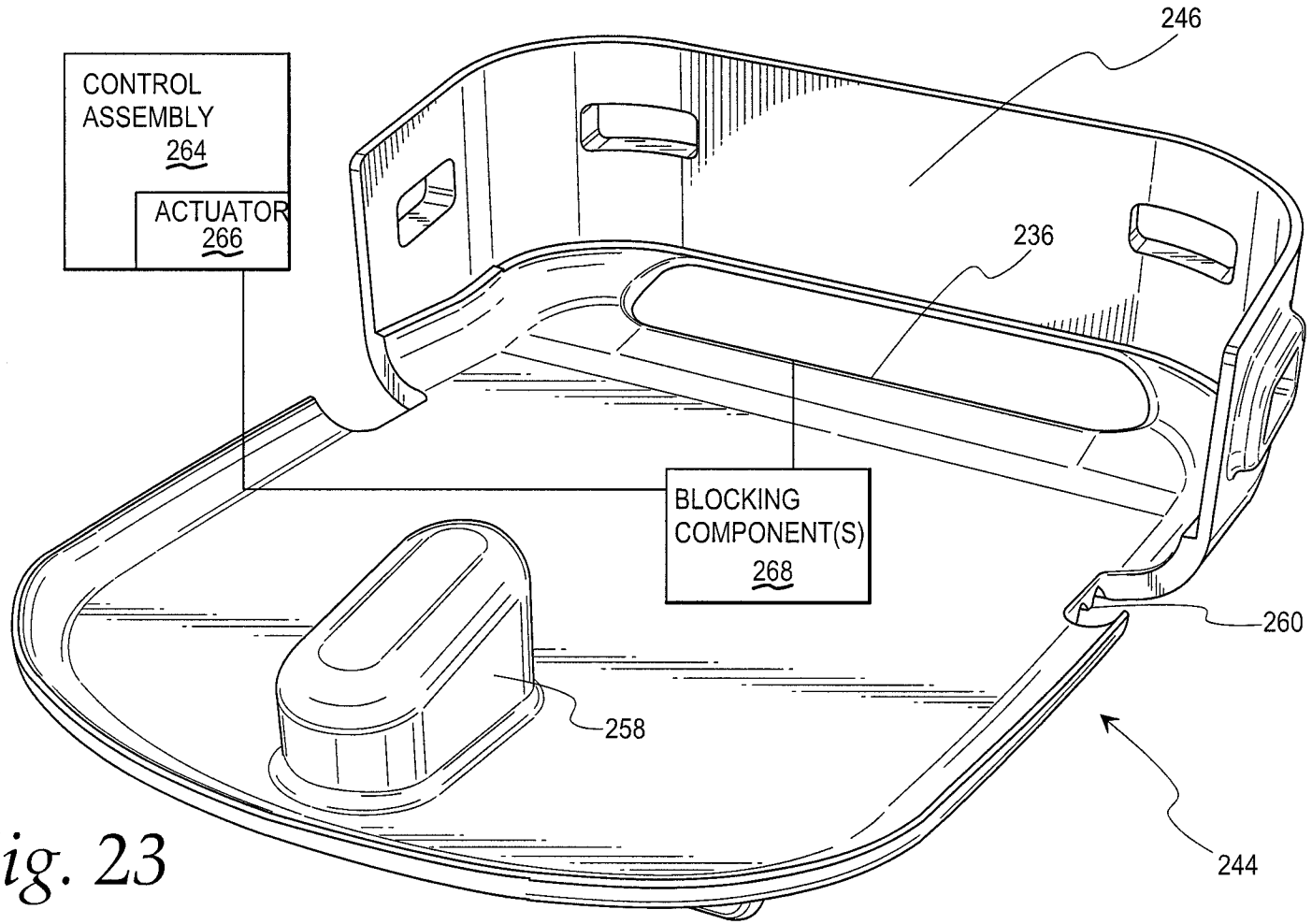
FIG. 23 is an enlarged, perspective view of an insert on the top wall of the fluid containment unit in FIGS. 18-22, on which the access member is provided, and with an optional control assembly incorporated to facilitate automatic collapsing of the peripheral wall structure upon partially or fully exhausting a fluid supply in a containment volume bounded thereby.

By constructing the wall structure 224 of suitable material, the wall structure 224, as shown schematically in FIGS. 24-26, can automatically assume different shapes depending upon a pressure differential between the outside atmosphere and the fluid containment volume. FIG. 24 schematically shows the peripheral wall structure 232, between the top wall 228 and bottom wall 230, fully extended as with the fluid containment volume either full or empty without operation of the portable humidifier 210.

In FIG. 25, with the fluid containment volume less than full and a negative pressure developed in the fluid containment volume achieving a predetermined level, the peripheral wall structure 232 begins to collapse vertically/axially, which brings the top and bottom walls 228, 230 closer to each other.

Further negative pressure, resulting from operation with limited, or no, venting and with a lower fluid volume contained, allows the peripheral wall structure 232 to fully collapse, whereby the top and bottom walls 228, 230 are in close proximity representing a fully collapsed state for the wall structure 224.

Accordingly, by reason of observing the different surrounding volumes in FIGS. 24-26, a user can quickly, and from a distance, visually ascertain the amount of fluid remaining in the fluid containment volume.

This latter feature may be incorporated for selective operation as by incorporating a control assembly 264 (FIG. 23) with an actuator 266 that repositions one or more blocking components 268 with respect to the opening 236, or any other opening(s), to thereby partially or fully block the same. Accordingly, by controlling the venting, the negative pressure generation in the fluid containment volume can be selectively controlled as the portable humidifier 210 is operating. Controlled blocking of the opening/vent 236 will allow the negative pressure buildup to cause the automatic collapsing of the peripheral wall structure 232 during operation, as shown schematically in FIGS. 24-26.

As noted above, the materials and precise construction of the wall structure 224, including the peripheral wall structure 232, can be selected to allow the automatic collapsing in a predetermined manner between at least the three exemplary shapes in FIGS. 24-26.

To facilitate drawing of the first and second walls 228, 230 away from each other, with the peripheral wall structure 232 initially collapsed, discrete surfaces 270, 272 are respectively provided on the top and bottom walls 228, 230. The surface 270 spans the width of the opening 238, faces downwardly, and allows engagement by a plurality of a user's fingers.

The surface 272 faces upwardly and oppositely to the surface 270. The surface 272 is defined on a handle 274 configured to be surrounded and grasped by a hand of a user.

Starting with the wall structure 224 in a collapsed state, a user can engage the surfaces 270, 272 with fingers on opposite hands and exert axial opposite forces tending to draw the top and bottom walls 228, 230 away from each other, thereby expanding the peripheral wall structure 232.

In this embodiment, a distribution nozzle 280 is seated in the top wall 228 at the opening/outlet 220.

The nozzle 280 defines a receptacle 282 for a scented component 284 that can be pressed thereinto. Vapor droplets discharging against the component 284 will pick up scent therefrom and distribute the same into a surrounding space.

The foregoing disclosure of specific embodiments is intended to be illustrative of the broad concepts comprehended by the invention.

The invention claimed is:

1. A portable humidifier comprising:

a frame;

a fluid droplet generator on the frame; and a fluid containment unit for a supply of fluid, the fluid droplet generator operable to cause fluid droplets to be generated from fluid from the supply in the fluid containment unit and to be discharged at an outlet to become entrained in environmental air in a space in which the portable humidifier is located, wherein the fluid containment unit comprises a wall structure that is selectively reconfigurable to occupy different surrounding volumes, wherein the wall structure comprises a peripheral wall portion bounding a part of a fluid containment volume, wherein the portable humidifier further comprises a collapsible guide column extending through the fluid containment volume and defining a passageway through which generated fluid droplets are guided between the fluid droplet generator and the outlet.

2. The portable humidifier according to claim 1 wherein the wall structure is reconfigurable back and forth in a predetermined manner between first and second shapes wherein the wall structure occupies different surrounding volumes.

3. The portable humidifier according to claim 2 wherein the wall structure is configured to contain a supply of fluid independently of the frame.

4. The portable humidifier according to claim 2 wherein the wall structure and frame are configured to cooperatively contain a supply of fluid.

5. The portable humidifier according to claim 1 wherein the wall structure comprises first and second spaced wall portions with the peripheral wall portion extending between the first and second wall portions and the wall structure is selectively reconfigurable to allow the first and second wall portions to be moved towards and away from each other.

6. The portable humidifier according to claim 1 wherein the fluid droplet generator is configured to generate fluid droplets by using at least one of: a) heat; b) water diffusion; c) ultrasonic energy; d) wicking; e) convection; and f) evaporation.

7. A portable humidifier having a top and bottom and comprising:

a frame;

a fluid droplet generator on the frame; and a fluid containment unit for a supply of fluid, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the portable humidifier is changeable between: a) a first state wherein the frame and fluid containment unit are fully separated from each other; and b) a second state wherein the fluid containment unit is operatively joined to the frame, by relatively translating the fluid containment unit and frame without requiring manipulation of any separate fasteners, wherein the fluid containment unit and frame are configured so that with the portable humidifier in the second state a weight of: a) the fluid containment unit; and b) a supply of fluid in the fluid containment unit causes the fluid containment unit to be urged downwardly against the frame, wherein the portable humidifier is configured so that with the portable humidifier in the second state generated fluid droplets are discharged from the fluid containment unit.

8. A portable humidifier having a top and bottom and comprising:

a frame;

a fluid droplet generator on the frame; and a fluid containment unit for a supply of fluid, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the wall structure comprises a peripheral wall portion extending around an axis and bounding a part of a fluid containment volume, the peripheral wall portion controllably collapsible in an axial direction to selectively increase and decrease the fluid containment volume, wherein the peripheral wall portion has a stepped perimeter that allows at least a first part of the peripheral wall portion to be moved relative to a second part of the peripheral wall portion to thereby change a degree of axial overlap of the first and second parts of the peripheral wall portion and, as an incident thereof, the fluid containment volume, wherein the fluid containment unit and frame are configured so that with the portable humidifier in the second state a weight of: a) the fluid containment unit; and b) a supply of fluid in the fluid containment unit causes the fluid containment unit to be urged downwardly against the frame, wherein the portable humidifier is configured so that with the portable humidifier in the second state generated fluid droplets are discharged from the fluid containment unit.

9. The portable humidifier according to claim 8 wherein the wall structure comprises a top wall portion connected to the peripheral wall portion, the top wall portion having an outlet through which fluid droplets generated by the fluid droplet generator discharge to a space in which the portable apparatus is located, wherein the wall structure comprises a bottom wall portion connected to the peripheral wall portion and there are connectors on the frame and bottom wall portion that cooperate to releasably maintain a predetermined operatively joined relationship between the fluid containment unit and the frame.

10. The portable humidifier according to claim 9 wherein the connectors on the frame and bottom wall portion comprise cooperating male and female parts that are movable into and out of a connected relationship by relative movement in an axial direction, wherein the male and female parts have radially oppositely facing surfaces.

11. A portable humidifier comprising:

a frame;

a fluid droplet generator on the frame; and a fluid containment unit for a supply of fluid, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the portable humidifier is configured so that as an incident of fluid droplets being generated and discharged from the portable humidifier, negative pressure is generated within an internal volume bounded at least in part by the wall structure that causes the wall structure to reconfigure to occupy different surrounding volumes, wherein the portable humidifier is configured so that as an incident of fluid droplets being generated and discharged from the portable humidifier the wall structure is reconfigured from a first shape into a second shape, the wall structure occupying a smaller surrounding volume in the second shape than in the first shape.

12. The portable humidifier according to claim 11 wherein the portable humidifier is configured so that a part of the wall structure collapses in a predetermined manner in changing from the first shape into the second shape.

13. A portable humidifier comprising:

a frame;

a fluid droplet generator on the frame; and a fluid containment unit for a supply of fluid, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the wall structure comprises first and second spaced wall portions and a peripheral wall portion extending between the first and second wall portions and the wall structure is selectively reconfigurable to allow the first and second wall portions to be moved towards and away from each other, wherein there is one discrete surface on the first wall portion facing in one direction and a second discrete surface on the second wall portion that faces oppositely to the one direction, the one and second discrete surfaces each engageable by fingers on a user's separate hands to allow an opposite force to be applied thereto to urge the first and second wall portions away from each other.

14. A portable humidifier comprising:

a frame;

a fluid droplet generator on the frame; and a fluid containment unit for a supply of fluid, the fluid containment unit separable from the frame, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the wall structure comprises first and second spaced wall portions and a peripheral wall portion extending between the first and second wall portions and the wall structure is selectively reconfigurable to allow the first and second wall portions to be moved towards and away from each other, wherein the first wall portion is a top wall and the second wall portion is a bottom wall, wherein the top wall has at least one opening through which fluid can be directed to replenish the supply of fluid in the fluid containment unit.

15. A portable humidifier comprising:

a frame;

a fluid droplet generator on the frame; and a fluid containment unit for a supply of fluid, the fluid droplet generator operable to cause fluid droplets to be generated from fluid from the supply in the fluid containment unit and to become entrained in environmental air in a space in which the portable humidifier is located, wherein the fluid containment unit comprises a wall structure that is selectively reconfigurable to occupy different surrounding volumes, wherein the wall structure comprises first and second spaced wall portions and a peripheral wall portion extending between the first and second wall portions and the wall structure is selectively reconfigurable to allow the first and second wall portions to be moved towards and away from each other, wherein the first wall portion is a top wall and the second wall portion is a bottom wall, wherein the top wall has an opening therethrough in communication with a fluid containment volume bounded at least in part by a peripheral wall portion on the wall structure, wherein the portable humidifier further comprises an access member movable between an open position and a blocking position, the access member in the blocking position at least partially blocking the opening in the top wall portion, wherein the top wall further has a fluid droplet discharge outlet for fluid droplets generated by the fluid droplet generator and the top wall opening is spaced from the fluid droplet discharge outlet.

16. The portable humidifier according to claim 15 wherein with the access member in the blocking position, the access member is situated to funnel fluid directed thereagainst into the top wall opening.

17. A portable humidifier comprising:

a frame;

a fluid droplet generator on the frame; and a fluid containment unit for a supply of fluid, the fluid droplet generator operable to cause fluid droplets to be generated from fluid from the supply in the fluid containment unit and to be discharged at an outlet to become entrained in environmental air in a space in which the portable humidifier is located, wherein the fluid containment unit comprises a wall structure that is selectively reconfigurable to occupy different surrounding volumes, wherein the portable humidifier has a fluid discharge for fluid droplets generated by the fluid droplet generator and another opening that vents a fluid containment volume bounded at least in part by a peripheral wall portion on the wall structure to control negative pressure generation in the fluid containment volume as the portable humidifier is operated.

18. The portable humidifier according to claim 17 further comprising a control assembly for selectively blocking the another opening, wherein the control assembly is configured to block the another opening as an incident of which negative pressure to a predetermined level can be generated in the fluid containment volume, the portable humidifier configured so that upon the predetermined level of negative pressure being realized, the surrounding volume of the wall structure is caused to change.

19. A method of conditioning air within a space, the method comprising the steps of:

a) obtaining a portable humidifier comprising:
- a frame;
- a fluid droplet generator on the frame and having "on" and "off" states; and
- a fluid containment unit for a supply of fluid and including a wall structure with a peripheral wall portion bounding a part of a fluid containment volume,
- the fluid containment unit reconfigurable between at least first and second shapes and occupying a smaller surrounding volume with the fluid containment unit in the first shape than in the second shape;

b) changing the fluid containment unit from the first shape into the second shape to thereby increase a size of a fluid containment volume defined by the fluid containment unit;

c) placing fluid in the fluid containment volume within the fluid containment unit;

d) with the fluid droplet generator in the "on" state and the fluid containment unit having the second shape, causing the fluid droplet generator to produce droplets of the fluid in the fluid storage volume and causing the fluid droplets to be guided through a passage defined by a collapsible guide column extending through the fluid containment volume so as to be discharged into the space;

e) changing the fluid droplet generator from the "on" state into the "off" state; and f) after performing steps d) and e), changing the fluid containment unit from the second shape back into the first shape.

20. The method of conditioning air within a space according to claim 19, wherein step f) comprises collapsing the wall structure in a predetermined manner.

21. The method of conditioning air within a space according to claim 19 further comprising the step of separating the fluid containment unit from the frame.

22. The method of conditioning air within a space according to claim 20 wherein the fluid containment unit has a vertical axis and the step of collapsing the wall structure comprises collapsing the wall structure to reduce an axial extent of the wall structure.

23. The method of conditioning air within a space according to claim 19 wherein the fluid containment unit has a vertical axis and further comprising the step of separating the fluid containment unit from the frame by translating the fluid containment unit axially relative to the frame.

24. The method of conditioning air within a space according to claim 19 wherein the step of obtaining the portable humidifier comprises obtaining the portable humidifier in a container in which the fluid containment unit has the first shape.

25. The method of conditioning air within a space according to claim 19 wherein the step of obtaining the portable humidifier comprises obtaining the portable humidifier in a container in which the fluid containment unit has the first shape and the fluid containment unit is operatively connected to the frame.

26. The method of conditioning air within a space according to claim 23 wherein the fluid containment unit has an oval shape as viewed along the vertical axis.

27. A method of conditioning air within a space, the method comprising the steps of:

a) obtaining a portable humidifier comprising:
- a frame;
- a fluid droplet generator on the frame and having "on" and "off" states; and
- a fluid containment unit for a supply of fluid,
- the fluid containment unit reconfigurable between at least first and second shapes and occupying a smaller surrounding volume with the fluid containment unit in the first shape than in the second shape;

b) changing the fluid containment unit from the first shape into the second shape to thereby increase a size of a fluid containment volume defined by the fluid containment unit;

c) placing fluid in the fluid containment volume within the fluid containment unit;

d) with the fluid droplet generator in the "on" state and the fluid containment unit having the second shape, causing the fluid droplet generator to produce droplets of the fluid in the fluid storage volume and causing the fluid droplets to be discharged into the space;

e) changing the fluid droplet generator from the "on" state into the "off" state; and f) after performing steps d) and e), changing the fluid containment unit from the second shape back into the first shape, wherein the fluid containment unit comprises a wall structure bounding the fluid containment volume and step f) comprises collapsing the wall structure in a predetermined manner, said method further comprising the steps of obtaining a cover that is separate from the portable humidifier and connecting the cover to the portable humidifier with the wall structure collapsed.

28. The method of conditioning air within a space according to claim 27 wherein the step of connecting the cover comprises press fitting the cover to the fluid containment unit.

29. A method of conditioning air within a space, the method comprising the steps of:

a) obtaining a portable humidifier comprising:
- a frame;
- a fluid droplet generator on the frame and having "on" and "off" states; and
- a fluid containment unit for a supply of fluid,
- the fluid containment unit reconfigurable between at least first and second shapes and occupying a smaller surrounding volume with the fluid containment unit in the first shape than in the second shape;

b) changing the fluid containment unit from the first shape into the second shape to thereby increase a size of a fluid containment volume defined by the fluid containment unit;

c) placing fluid in the fluid containment volume within the fluid containment unit;

d) with the fluid droplet generator in the "on" state and the fluid containment unit having the second shape, causing the fluid droplet generator to produce droplets of the fluid in the fluid storage volume and causing the fluid droplets to be discharged into the space;

e) changing the fluid droplet generator from the "on" state into the "off" state; and f) after performing steps d) and e), changing the fluid containment unit from the second shape back into the first shape, said method further comprising the step of changing the fluid containment unit from the second shape as an incident of performing step d).

30. A method of conditioning air within a space, the method comprising the steps of:

a) obtaining a portable humidifier comprising:

a frame;

a fluid droplet generator on the frame and having "on" and "off" states; and a fluid containment unit for a supply of fluid, the fluid containment unit reconfigurable between at least first and second shapes and occupying a smaller surrounding volume with the fluid containment unit in the first shape than in the second shape;

b) changing the fluid containment unit from the first shape into the second shape to thereby increase a size of a fluid containment volume defined by the fluid containment unit;

c) placing fluid in the fluid containment volume within the fluid containment unit;

d) with the fluid droplet generator in the "on" state and the fluid containment unit having the second shape, causing the fluid droplet generator to produce droplets of the fluid in the fluid storage volume and causing the fluid droplets to be discharged into the space;

e) changing the fluid droplet generator from the "on" state into the "off" state; and f) after performing steps d) and e), changing the fluid containment unit from the second shape back into the first shape, said method further comprising the step of changing the fluid containment unit from the second shape into the first shape as an incident of performing step d).

* * * * *